US011299341B2

(12) United States Patent
Grip et al.

(10) Patent No.: US 11,299,341 B2
(45) Date of Patent: Apr. 12, 2022

(54) MODULAR CARGO CONTAINERS WITH SURFACE CONNECTORS

(71) Applicant: THE BOEING COMPANY, Chicago, IL (US)

(72) Inventors: Robert Erik Grip, Rancho Palos Verdes, CA (US); Michael S. Karapetian, Huntington Beach, CA (US); John J. Brown, Costa Mesa, CA (US)

(73) Assignee: THE BOEING COMPANY, Chicago, IL (US)

( * ) Notice: Subject to any disclaimer, the term of this patent is extended or adjusted under 35 U.S.C. 154(b) by 20 days.

(21) Appl. No.: 16/720,185

(22) Filed: Dec. 19, 2019

(65) Prior Publication Data

US 2021/0188535 A1 Jun. 24, 2021

(51) Int. Cl.

| | |
|---|---|
| ***B60P 7/13*** | (2006.01) |
| ***B65D 90/00*** | (2006.01) |
| ***B65D 88/02*** | (2006.01) |
| *B65D 88/14* | (2006.01) |
| *B65D 88/12* | (2006.01) |

(52) U.S. Cl.

CPC ..... *B65D 90/0006* (2013.01); *B65D 88/022* (2013.01); *B65D 90/0026* (2013.01); *B65D 88/121* (2013.01); *B65D 88/14* (2013.01); *B65D 2590/0008* (2013.01)

(58) Field of Classification Search

CPC .... B65D 88/14; B65D 88/121; B65D 88/022; B65D 90/0006; B65D 90/008; B65D 90/0026; B65D 2590/0008; B65D 21/02; B65D 21/00; B65D 21/0201; B65D 21/0215; B65D 21/0204

USPC ..... 220/1.5, 4.26, 4.27, 23.2, 23.4, 23.6

See application file for complete search history.

(56) References Cited

U.S. PATENT DOCUMENTS

| | | | | |
|---|---|---|---|---|
| 3,563,403 A | | 2/1971 | Luisada et al. | |
| 3,598,273 A | | 8/1971 | Rau et al. | |
| 3,706,392 A | | 12/1972 | Sprick et al. | |
| 3,711,902 A | * | 1/1973 | Eggert, Jr. | B60P 7/13 24/287 |
| 3,966,075 A | | 6/1976 | Schultz | |

(Continued)

FOREIGN PATENT DOCUMENTS

| | | |
|---|---|---|
| FR | 2732313 A1 | 10/1996 |
| GB | 2485333 A | 5/2012 |
| WO | 2010106367 A2 | 9/2010 |

OTHER PUBLICATIONS

European Patent Office Extended European Search Report for Application No. 20211436.9-1016 dated Nov. 5, 2021.

*Primary Examiner* — Don M Anderson
*Assistant Examiner* — Elizabeth J Volz
(74) *Attorney, Agent, or Firm* — Patterson + Sheridan, LLP

(57) ABSTRACT

Certain aspects of the present disclosure provide techniques for a modular container, including: six sides, wherein: each side of the six sides of the modular container comprises at least four surface connector arrangements, each surface connector arrangement of the at least four surface connector arrangements comprises at least two connector elements, wherein: at least one connector element of the at least two connector elements is of a first type, and at least one connector element of the at least two connector elements is of a second type; and an access door in at least one side of the six sides.

20 Claims, 24 Drawing Sheets

(56) References Cited

U.S. PATENT DOCUMENTS

| | | | | |
|---|---|---|---|---|
| 4,695,184 | A * | 9/1987 | Robishaw | B60P 7/13 114/249 |
| 4,759,668 | A | 7/1988 | Larsen et al. | |
| 6,010,021 | A * | 1/2000 | Zuidam | B65D 21/02 206/499 |
| 6,299,008 | B1 | 10/2001 | Payne | |
| 10,308,424 | B2 * | 6/2019 | Vancampen | B65D 90/0026 |
| 10,947,036 | B2 * | 3/2021 | Helou, Jr. | B60P 3/00 |
| 2007/0000921 | A1 | 1/2007 | Butler et al. | |
| 2017/0283114 | A1 * | 10/2017 | Marschall | B65D 21/0201 |
| 2018/0194548 | A1 | 7/2018 | Helou, Jr. | |

* cited by examiner

600

MODULAR CARGO CONTAINERS WITH SURFACE CONNECTORS

INTRODUCTION

Aspects of the present disclosure relate to cargo containers, and in particular to modular cargo containers that include surface connector arrangements.

Cargo containers are moved about the world by various types of crafts, such as trucks, ships, trains, and aircraft. In order to facilitate shipment of goods in a global economy, standards for shipping containers have been developed to enable intermodal shipping. So-called "ISO" containers are containers with standardized outer dimensions as well as standardized connection point locations and hardware so that containers may reliably be carried from place to place by various types of crafts with complementary container connection equipment.

Unfortunately, the high-degree of standardization in container size and fitting locations means that smaller containers, which may be a better fit physically and economically for various types of cargo, are not usable with standardized container transport vehicles. Accordingly, there is a need for modular containers that come in a wider variety of sizes and that include connection features to allow agglomeration to larger containers that maintain compatibility with existing cargo container standards.

BRIEF SUMMARY

Certain embodiments provide a modular container, comprising: six sides, wherein: each side of the six sides of the modular container comprises at least four surface connector arrangements, each surface connector arrangement of the at least four surface connector arrangements comprises at least two connector elements, wherein: at least one connector element of the at least two connector elements is of a first type, and at least one connector element of the at least two connector elements is of a second type; and an access door in at least one side of the six sides.

Further embodiments provide an agglomerated container, comprising: a plurality of modular containers, wherein: each respective modular container of the plurality of modular containers comprises six sides, each side of the six sides of a respective modular container comprises at least four surface connector arrangements, wherein: each surface connector arrangement of the at least four surface connector arrangements comprises at least two connector elements, at least one connector element of the at least two connector elements is of a first type, and at least one connector element of the at least two connector elements is of a second type; and each respective modular container of the plurality of modular container is connected to another modular container of the plurality of modular containers via an interface between one or more surface connector arrangements on a first side of the respective modular container and one or more surface connector arrangements on a first side of the another modular container.

Further embodiments provide a method of forming an agglomerated container, comprising: connecting a plurality of modular containers to form an agglomerated container, wherein: each respective modular container of the plurality of modular containers comprises six sides, wherein: each side of the six sides of the modular container comprises at least four surface connector arrangements, each surface connector arrangement of the at least four surface connector arrangements comprises at least two connector elements, wherein: at least one connector element of the at least two connector elements is of a first type, and at least one connector element of the at least two connector elements is of a second type; each respective modular container of the plurality of modular container is connected to another modular container of the plurality of modular containers via an interface between one or more surface connector arrangements on a first side of the respective modular container and one or more surface connector arrangements of a first side of the another modular container.

The following description and the related drawings set forth in detail certain illustrative features of one or more embodiments.

BRIEF DESCRIPTION OF THE DRAWINGS

The appended figures depict certain aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Figure 1A:
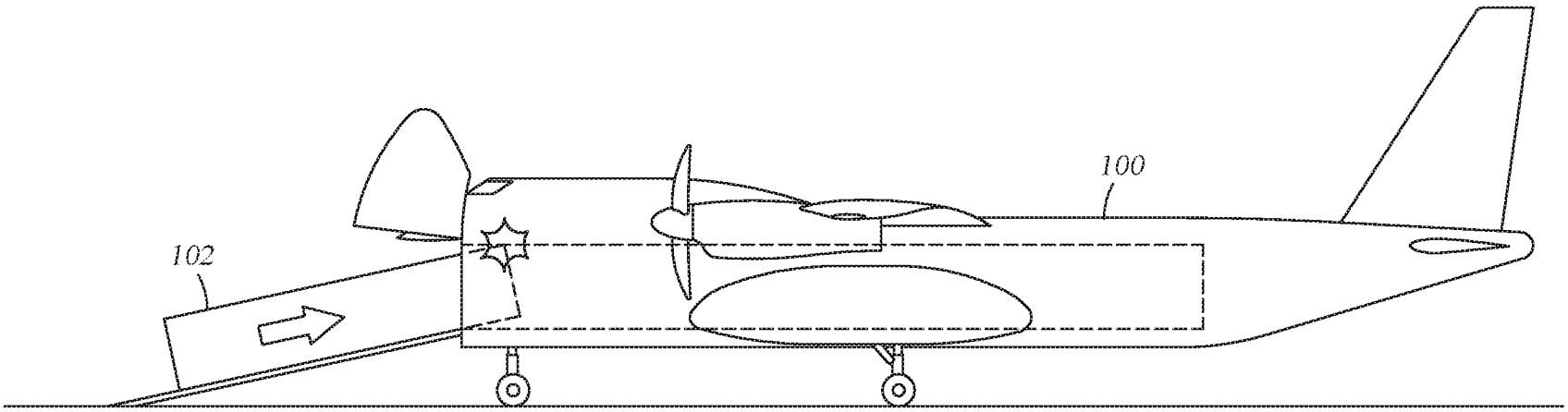
FIGS. 1A and 1B depict examples of loading large ISO containers on to an aircraft.

Aspects of the present disclosure provide modular containers that include connection features to allow agglomeration to larger containers, which in some arrangements maintain compatibility with existing cargo container standards.

Cargo carrying crafts, such as trucks, ships, trains, and aircraft move a great amount of cargo around the world. In order to do so efficiently, standardized container sizes and fittings have emerged to allow for efficient intermodal shipping.

Amongst the most commonly used container configurations in the world are the 20-foot and 40-foot "ISO" containers. Because of their common use, cargo carrying crafts, such as trucks, trailers, and rail cars, are generally configured with container connection equipment, such as retainers, mounts, locks, etc., that match complimentary container fittings on 20 and 40-foot containers. In some cases, larger containers, such as 45-foot, 48-foot, and 53-foot containers may still be carried by the same sort of craft using fittings that adhere to the 40-foot standard.

A shortcoming of larger ISO containers, such as 20 and 40-foot containers, is that cargo frequently must be "broken down" and reconsolidated into smaller loads along its route between origin and destination. As an example of this issue, consider a manufacturer of televisions in in a first location. In a given day, the manufacturer may produce enough TVs to fill an ISO container (e.g., a 20 or 40-foot ISO container). The ISO container is then loaded onto a truck, which takes it to a port, where it may be loaded onto a ship. At a destination port, the ISO container is unloaded from the ship, and then placed onto a truck or a train. However, at some point, the ISO container full of TVs must be unloaded and its contents separated and resorted because few customers may have a need for a whole ISO container full of TVs. For example, a retail store may want ten TVs at a time, not two hundred. This unloading and reloading takes time and energy, and thus reduces the efficiency of the shipping process. Further, this unloading and reloading increases the opportunities for damage and/or theft while in transit.

A related problem is the "less-than-load" problem. For example, a significant fraction of cargo-carrying trucks carry containers with cargo from more than one shipper. This is because many shippers or customers do not have enough cargo to fill a whole container. Consequently, shippers commonly arrange for a "freight forwarder" or third party logistics company to consolidate the cargo from two or more customers into a single container (e.g., an ISO container), so that a carrying craft (e.g., a truck) moves a full load. However, this consolidation process requires time, energy, and cost, and thus reduces the efficiency of the shipping process.

Further, large ISO cargo containers pose special challenges to certain types of cargo-carrying craft. For example, 20 and 40-foot ISO containers are difficult to load into an aircraft because of the large external dimensions of the containers and relatively constrained internal dimensions of the aircraft. For this reason, aircraft have conventionally used specially designed unit load devices (ULDs), which may be in the form of a pallet or container used to load luggage, freight, and mail on both wide-body and narrow-body aircraft. ULDs allow a large quantity of cargo to be bundled into a single unit, which reduces unit load count and saves ground crews time and effort. However, ULDs are not compatible with other intermodal cargo carrying vehicles. For example, ULDs cannot connect to ISO-standard connectors on trucks or trains, and so cargo in ULDs needs to be offloaded from the ULDs into ISO-compatible containers and vice versa several times in any shipment. Here again, this takes time and exposes the cargo to more opportunities for damage.

Figure 1B:
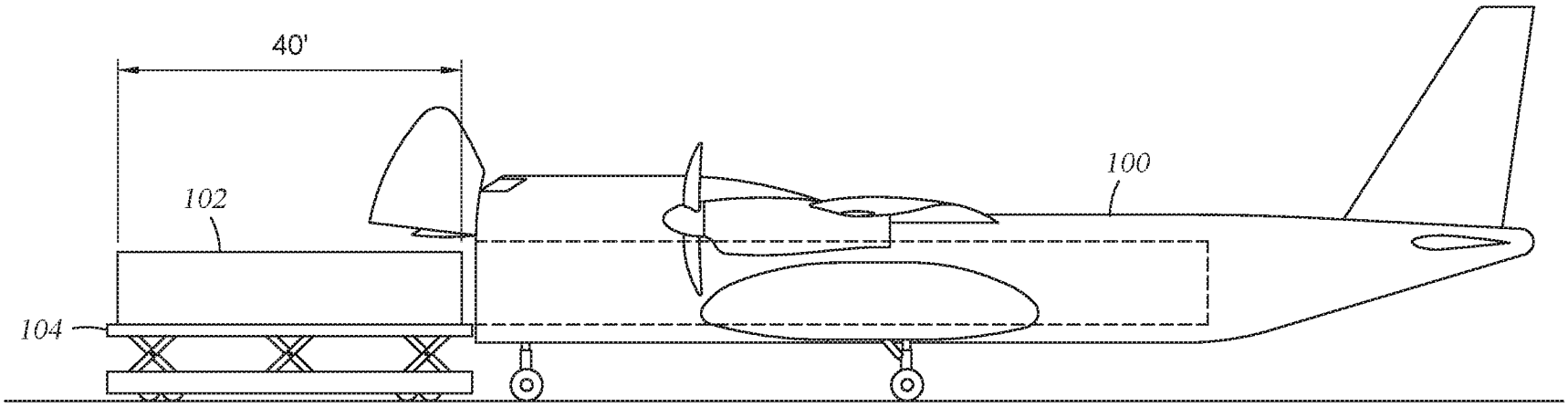

FIG. 1A depicts an example of a challenge in loading a 40-foot container 102 into aircraft 100. As depicted, the container 102 cannot be loaded using a ramp, despite the special purpose retracting nose of aircraft 100, because it will impact the interior of the cargo area of aircraft 100. Consequently, special machinery, such as lifting cart 104 in FIG. 1B, must be used to load and offload large cargo containers, such as ISO containers. Unfortunately, the requirement for specialized loading and unloading machinery means that aircraft, such as aircraft 100, can only be loaded and unloaded at airports that have such equipment. Getting and maintaining such equipment at many airports is costly and logistically complex.

Further, the large size of container 102 allows weight to be distributed unevenly across the area of container 102, which may negatively affect the center of gravity and thus performance of aircraft 100. For example, experimentation has shown that a 40-foot cargo container with uneven load may move the center of gravity of a cargo aircraft as much as ten feet, and a 20-foot cargo container may move the center of gravity as much as one and a half feet. Moving the center of gravity of an aircraft may negatively affect flight characteristics of the aircraft, such as stability and controllability. Further, movement of the center of gravity beyond an optimal location may require actively trimming the aircraft's aerodynamic surfaces to counter the center of gravity shift, which may lead to more drag, higher fuel usage, and slower flight.

Smaller standardized shipping containers exist, such as a "Bicon" container, which fits two containers in the space of a standard twenty-foot ISO container, a "Tricon" container, which fits three containers in the space of a standard twenty-foot ISO container, and a "Quadcon" container, which fits four containers in the space of a standard 20-foot ISO container. However, there are many issues with these existing containers that make them economically undesirable for modular shipping.

First, Bicons, Tricons, and Quadcons require special hardware to connect to each other's corner fitting in order that the connected unit can then be attached to standard connection equipment. Further, the special hardware adds weight, time, and cost to the use of such containers. Moreover, each of the corner fittings used for connecting adjacent containers is not available for connecting the joined containers to a carrying vehicle.

Second, Bicons, Tricons, and Quadcons need an approximate 3 inch gap between each container to accommodate the special connection hardware. The gap between the connected containers reduces the strength of the connected containers as a single structure because shear forces and loads run through the connectors instead of being shared by abutted walls of the containers.

Third, even though, for example, the Quadcon container is much smaller than a 20-foot ISO container, it is generally not small enough to relieve the less-than-load problem described above. For example, if a manufacturer produces a retail product such as an appliance that can be shipped in a box that has a volume of one cubic foot, a forty-foot container can carry approximately 3,000 of them; a 20-foot container can carry 1,500; and a Quadcon container can carry about 350. Thus, even the smallest of the standardized containers may carry far more cargo than needs to be shipped to any one location.

Fourth, Bicons, Tricons, and Quadcons have large tare weights because they are generally made of steel (being designed for rough duty in the military). 20-foot and 40-foot ISO containers also have large tare weights. While robust, the heavy tare weight of these containers makes them less efficient—which is especially problematic when carrying them on an aircraft. For these reasons, Bicon, Tricon, and Quadcon containers have not gained commercial acceptance.

Modular Containers with Surface Connector Arrangements

In order to increase the flexibility of moving cargo from place to place, modular containers are described herein, which are generally smaller than ISO standard containers, but which may be connected to each other to form large agglomerated containers that maintain compatibility with existing ISO standard connection equipment used by various sorts of transport vehicles. The modularity and size variability of the modular containers described herein provide for new capabilities for enclosing cargo for shipment.

Modular containers described herein may include a surface connector arrangement or pattern that may be utilized with many different container sizes by repeating the patterns, such as on faces of the modular containers.

Figure 2:
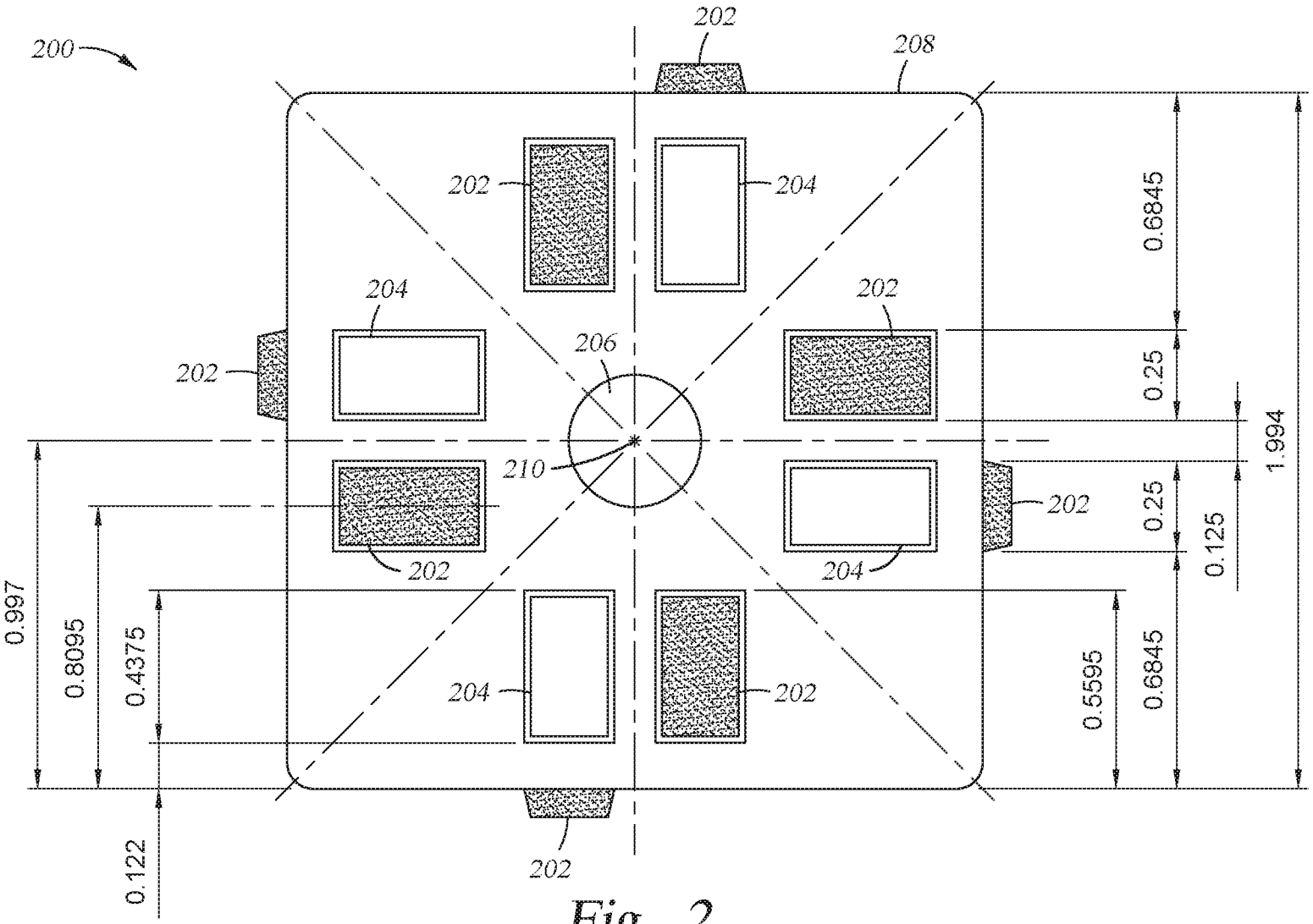
FIG. 2 depicts an example of a module that includes a 2-inch surface connector arrangement.

FIG. 2 depicts an example of a module 200 that includes a nominal 2-inch surface connector arrangement with connector elements 202 of a first type and connector elements 204 of a second type in a 2-inch pattern. Module 200 also includes an aperture 206 in the center of face 208.

In this embodiment, 2-inch pattern refers to the arrangement of connector elements fitting within a 2-inch square bounding box. Notably, the pattern of connector elements has rotational symmetry about the center 210 of module 200. In other words, module 200 presents the same pattern of connector elements when rotated by any 90 degree increment. Further, the face 208 is divided by dashed lines, which indicate eight zones in which connectors can be arranged to maintain rotational symmetry. For example the connector of the first type (e.g., connector element 204) in the top right zone is matched by the connector of the first type (e.g., connector element 204) in the bottom left zone, and so on around the arrangement.

The first type of connector element 202 (e.g., a "male" connector element) may comprise a protrusion, projection, pad or the like configured to fit within a recess of a second type of connector element 204 (e.g., a "female" connector element). In some embodiments, connector elements 202 and 204 may further include latches, magnetic connectors, pit pins, threaded rods, etc. In some embodiments, the connector elements may be manually locked and unlocked by means of a lever or other mechanical device, or they may be electrically activated by a powered mechanism inside the container.

Figure 3:
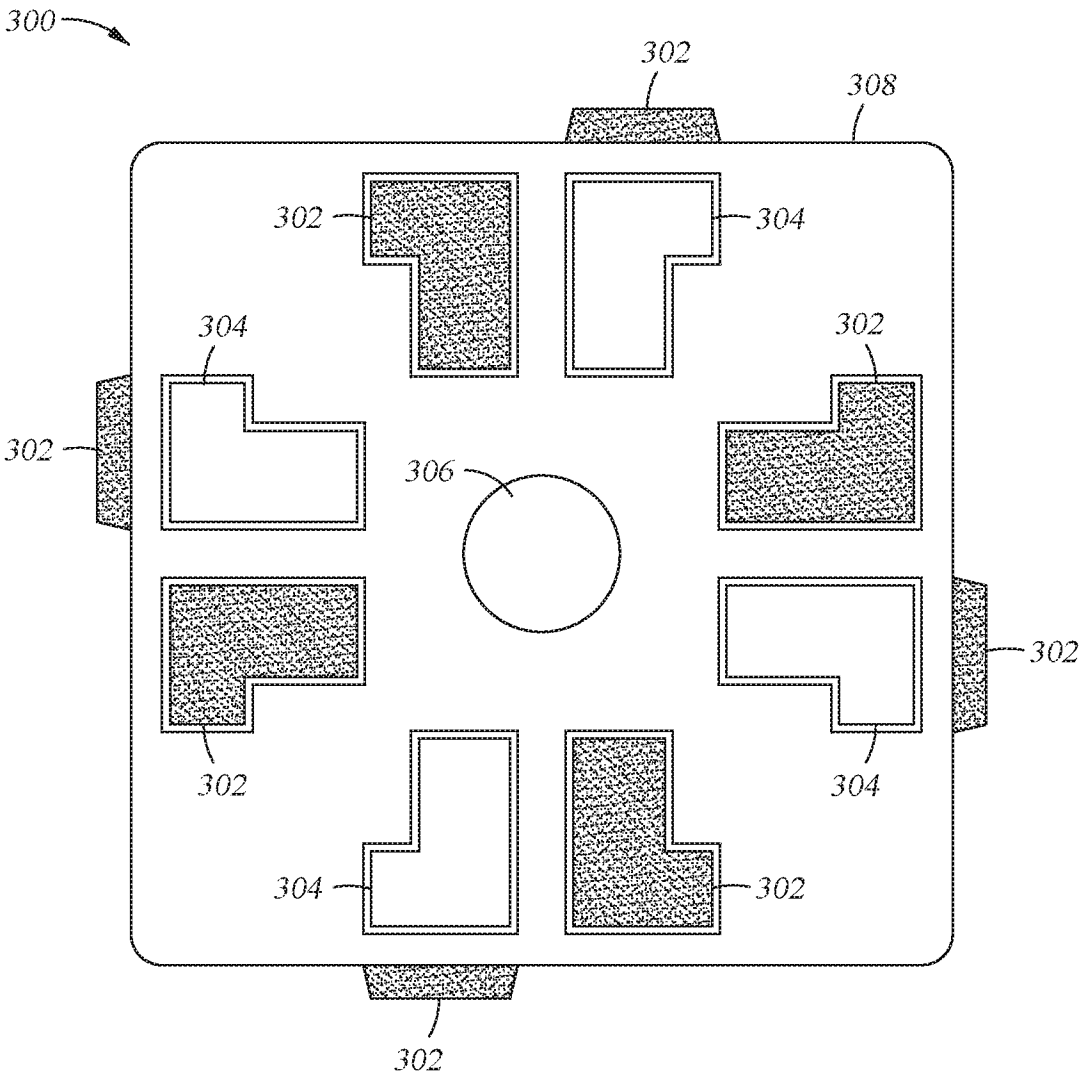
FIG. 3 depicts another example of a module that includes another 2-inch surface connectors arrangement.

Notably, the shapes of the connector elements 202 and 204 are just one example, and many shapes are possible. For example, FIG. 3 depicts another example of a module 300 that includes connector elements 302 of a first type and connector elements 304 of a second type, which are a different shape than those depicted in FIG. 2. However, like in FIG. 2, the arrangement or pattern of surface connectors on face 308 of module 300 are rotationally symmetric about the center of module 300, which includes aperture 306.

Figure 4A:
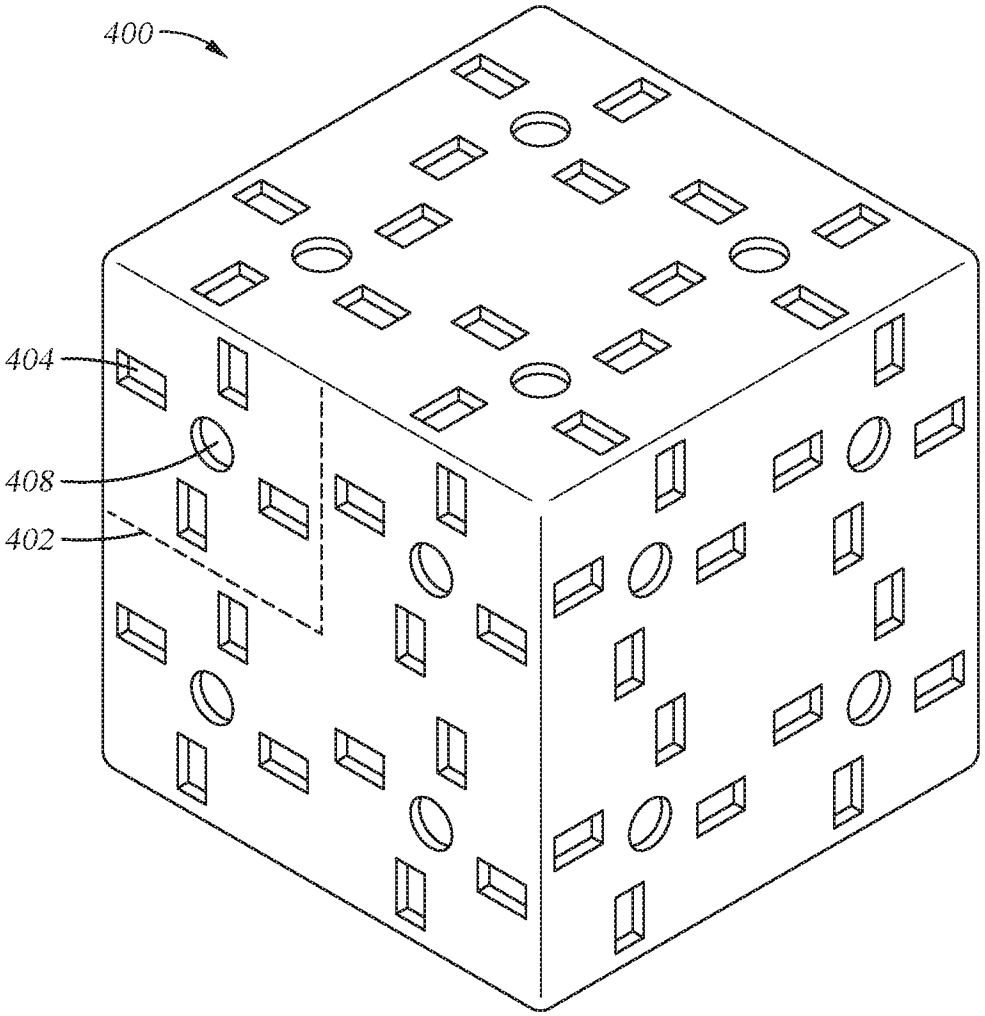
FIGS. 4A-C depict examples of modular containers with varying surface connector arrangements.
Figure 4B:
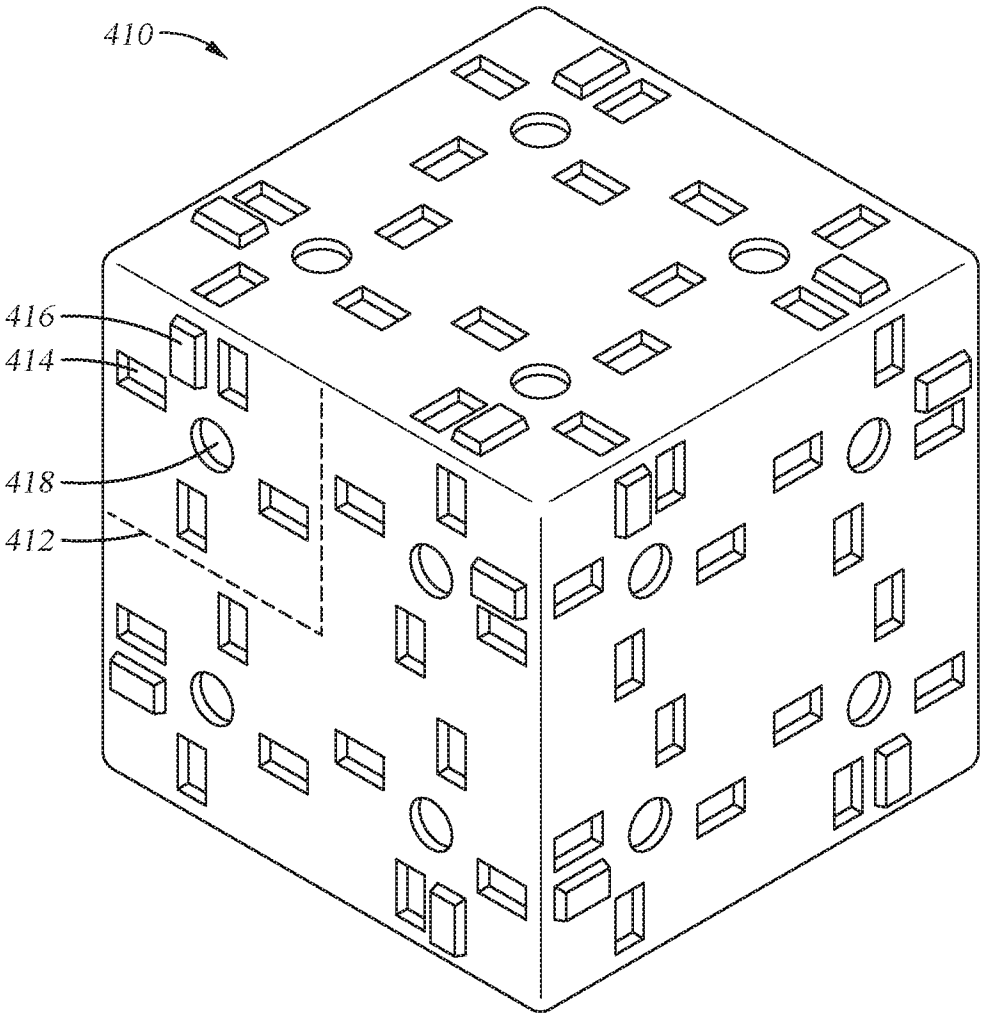
Figure 4C:
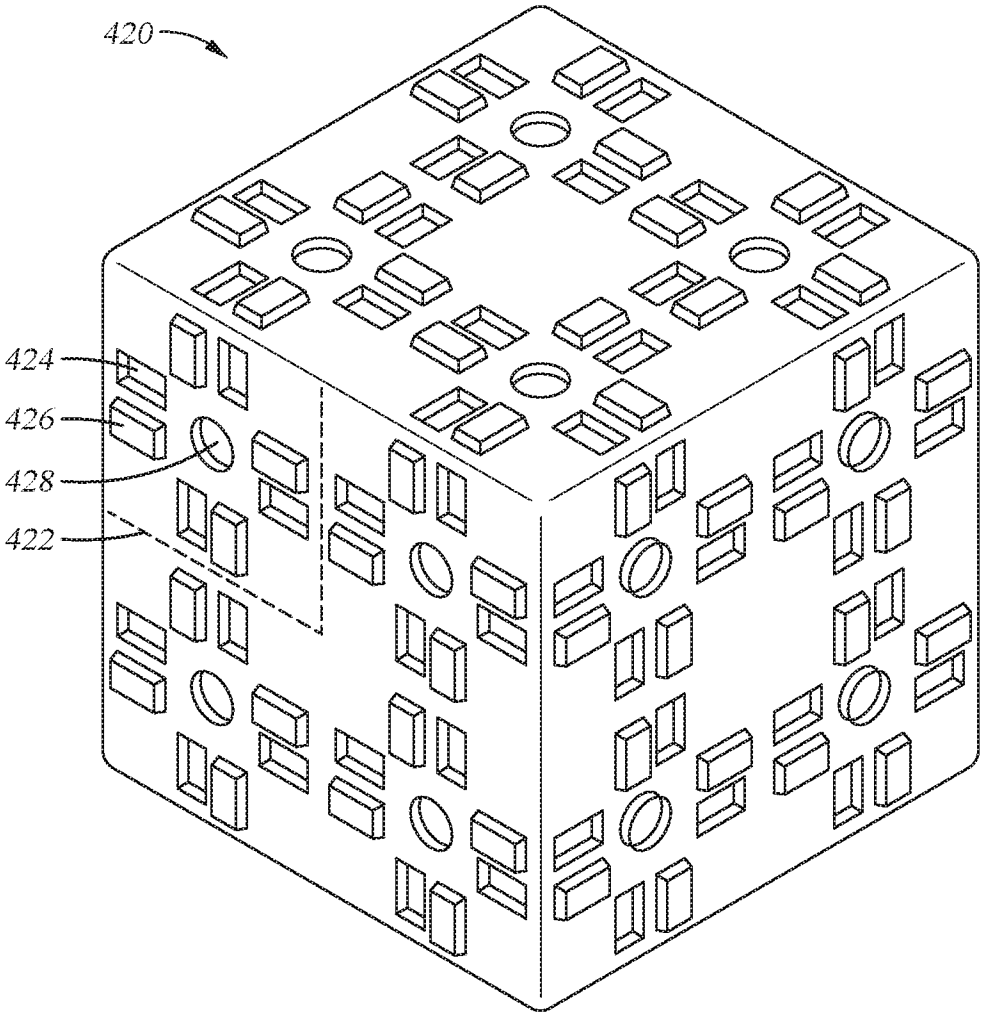

FIGS. 4A-C depict examples of modular containers with varying surface connector arrangements.

In particular, FIG. 4A depicts an example modular container 400, which includes four surface connector arrangements (or patterns) 402 on each face, and each connector arrangement 402 maintains rotational symmetry about the center of the arrangement.

Modular container 400 is a "passive" or "one-way" configuration in which all of the connector elements 404 are of a single type, which are female type recesses in this example. Thus, modular container 400 may be intended to have other modular containers attached to it, but not to attach to other modular containers without another connection mechanism.

Because modular container 400 is passive, it may not be expected to carry tension loads that are normal to the face of the container, or shear loads unless adjacent containers have some means to interfacing with the recesses. However, it can still carry compression loads normal to the face of the container.

FIG. 4B depicts modular container 410, which includes four surface connector arrangements (or patterns) 412 on each face, and each connector arrangement 412 maintains rotational symmetry about the center of the arrangement.

Modular container 410 is an "active" or "two-way" configuration in which the connector elements of each surface connector arrangement 412 includes two types of connector elements, including in this connector elements 416 of a first type (e.g., protrusions) and connector elements 414 of a second type (e.g., recesses). Thus, modular container 410 may be intended to have other modular containers attached to it and to attach to other modular containers without another connection mechanism.

In this example, there is the minimum non-zero number of connector elements of the first type within each surface connector arrangement 412. Further, the connector elements 416 of the first type (protrusions) are located nearest the corners of modular container 410 while maintaining the rotationally symmetric pattern.

Other embodiments, may not have symmetric surface connector arrangements on a face. For example, in an alternative embodiment (not pictured), only two of the four surface connector arrangements on each face might include protrusions, which would still provide resistances to torsional forces normal to each face when modular containers are connected.

Because in this example there are fewer connector elements of the first type (protrusions) than of the second type (recesses), surface connector arrangement 412 allows for a variety of complementary surface connector arrangements having different numbers of connector elements of the first type (protrusions) to attach to modular container 410. For example, two, three, or four connector elements of the first type in a complementary arrangement could be used to attach to modular container 410. Thus, modular container 410 may be intended to have other modular containers attached to it and to attach to other modular containers without another connection mechanism.

In another embodiment, the relative number of connector elements of the first type (protrusions) and of the second type (recesses) could be reversed, such that there were more connector elements of the first type than the second type. However, in order to make sure that modular containers could always interface correctly (e.g., where a protrusion has no matching recess with which to interface), the protrusions may be made spring-loaded.

FIG. 4C depicts modular container 420, which includes four surface connector arrangements (or patterns) 422 on each face (or sixteen total across the modular container), and each connector arrangement 422 maintains rotational symmetry about the center of the arrangement.

Modular container 420 is another active or two-way configuration in which the connector elements of each surface connector arrangement 422 includes two types of connector elements, including in this example connector elements 426 of a first type (e.g., protrusions) and connector elements 424 of a second type (e.g., recesses). Thus, modular container 420 may be intended to have other modular containers attached to it and to attach to other modular containers without another connection mechanism.

In this example, the larger number of connector elements 426 of the first type, as compared to the example in FIG. 4B, adds for additional face-to-face shear transfer capability when modular containers are connected. This is because the additional interfaces of the connector elements 426 with complementary connector elements on adjacent containers (not shown) creates more shear capacity.

Notably, in this example, there are the same number of connector elements 424 of the first type (protrusions) as the connector elements 426 second type (recesses).

Modular containers 400, 410, and 420 may be made of a wide variety of materials, including metals, plastics, composites, or even paper-based materials, such as cardboard. Depending on the type of material, certain embodiments of modular container may be considered disposable. In some cases, the choice of materials may be influenced by the required amount of shear loads that can be transferred through the recesses and protrusions from one modular container to another.

In each of FIGS. 4A-4C, there are also central recesses 408, 418, and 428, which may also be apertures in other embodiments, which are centered in the surface connector arrangements 402, 412, and 422, respectively. In these examples, the central recesses 408, 418, and 428 are configured to be used by robots end effectors for manipulating the modular containers.

Figure 5A:
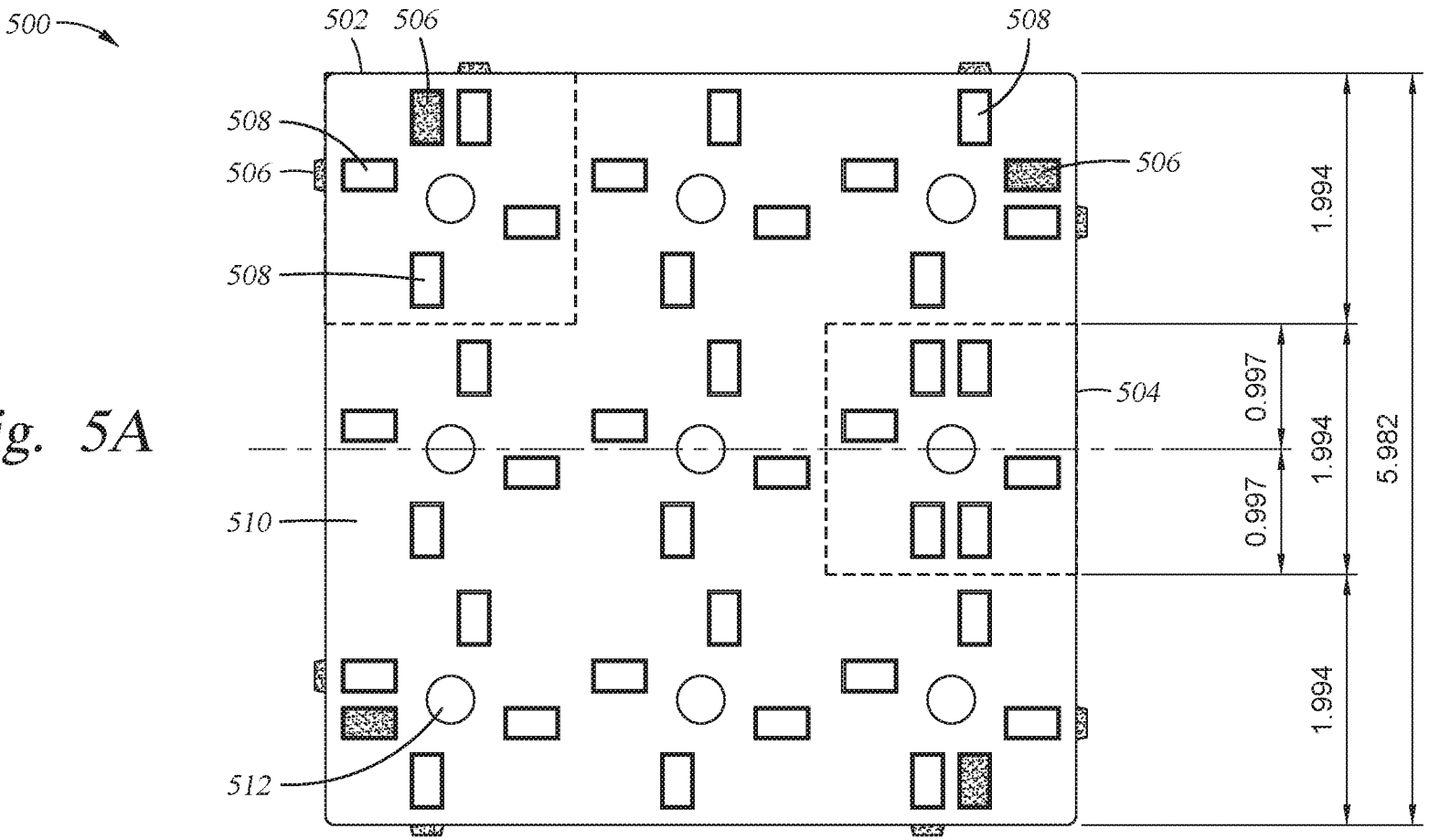
FIGS. 5A-C depict further examples of modular containers with varying surface connector arrangements.
Figure 5B:
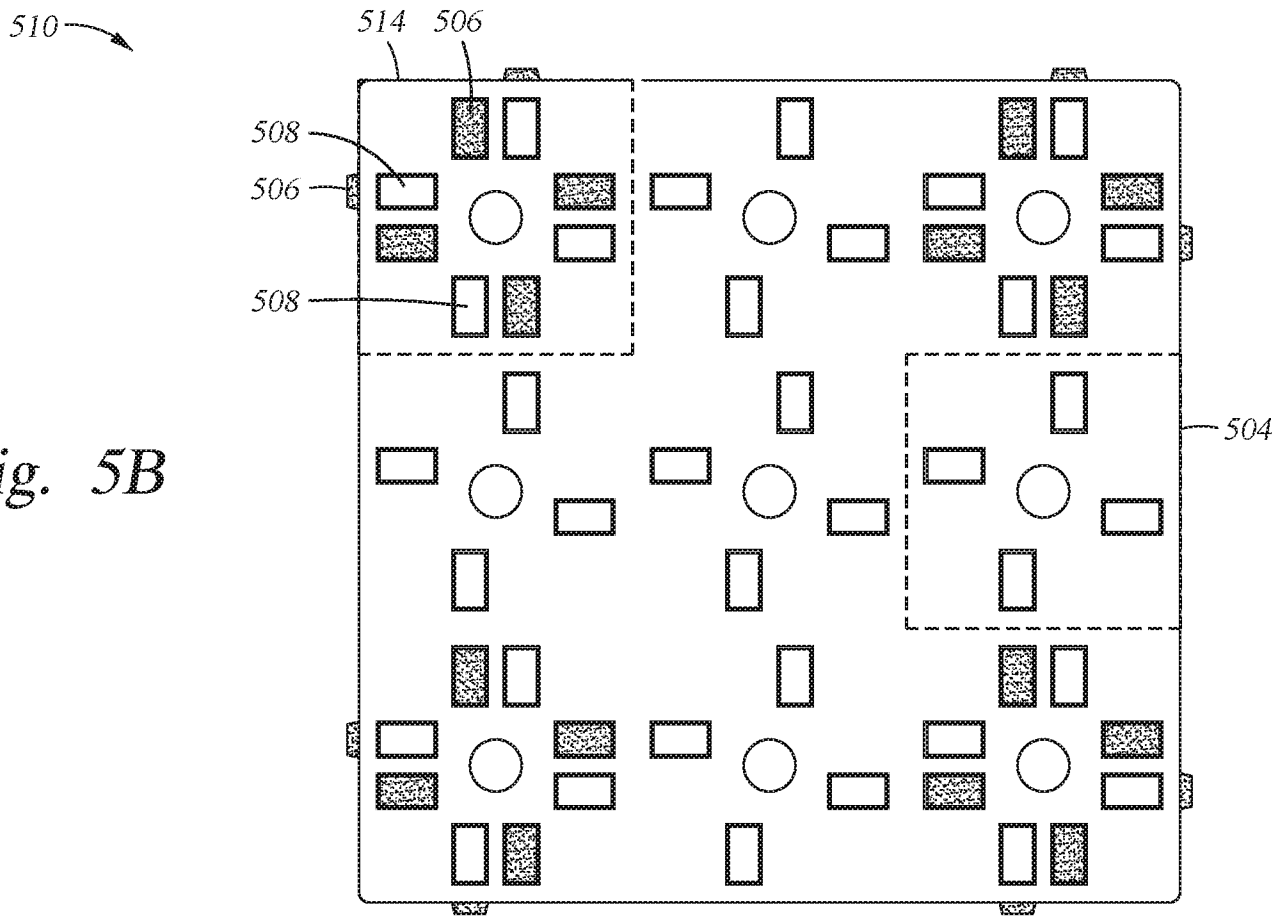
Figure 5C:
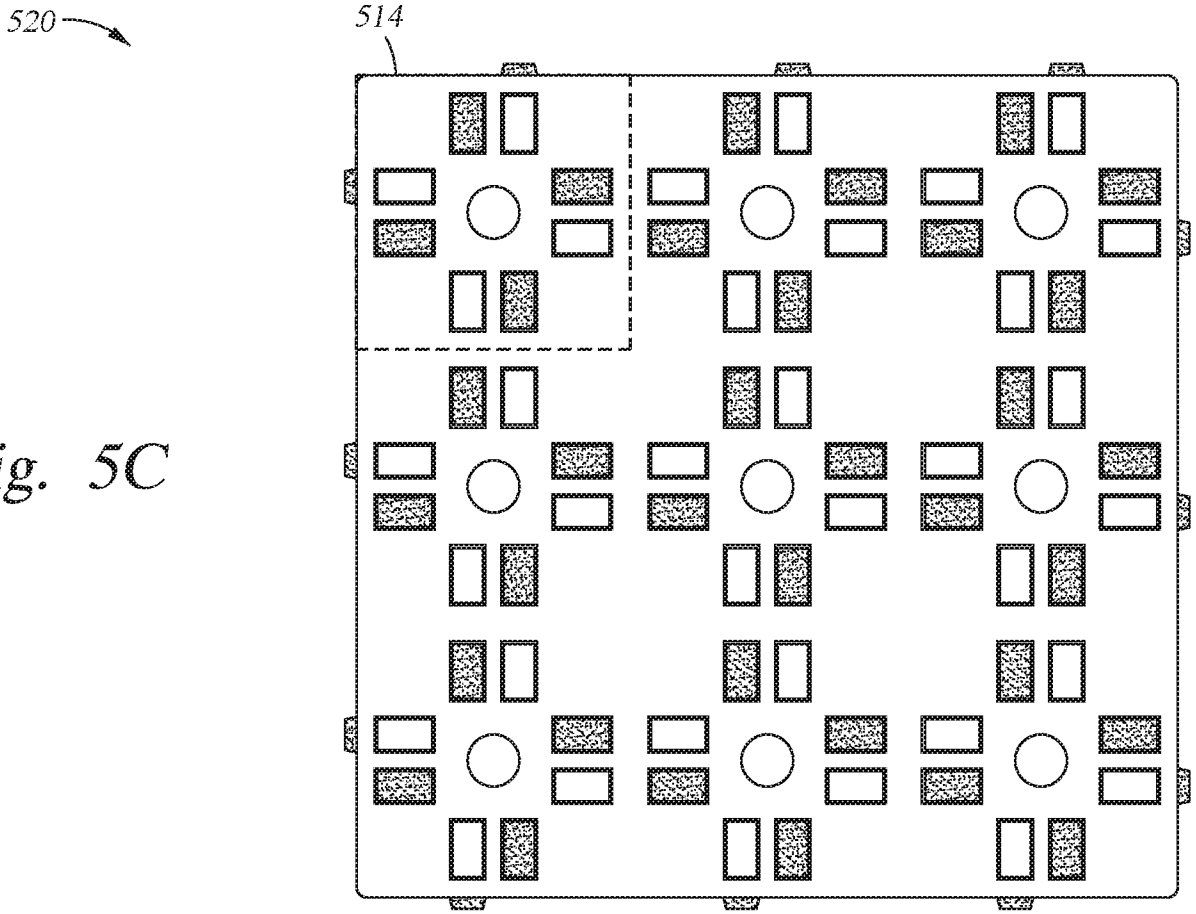

FIGS. 5A-C depict further examples of modular containers with varying surface connector arrangements.

In particular, FIG. 5A depicts another example modular container 500 including two different types of surface connector arrangements, 502 and 504.

In particular, the corners of modular container 500 include a surface connector arrangement 502 of a first type while the remaining surface of each face includes a surface connector arrangement 504 of a second type. The outer dimensions of each of the surface connector arrangements are consistent, which allows for their uniform and symmetric dispersal across the face of modular container 500 in a grid-like pattern.

The surface connector arrangement 502 of the first type includes two types of connector elements 506 and 508. The first type of connector element 506 is a protrusion (e.g., male type) while the second type of connector element 508 is a recess (e.g., female type). As in the example in FIG. 4B, the connector elements 506 of the first type (protrusions) are located nearest the corners of modular container 500 while maintaining the rotationally symmetric pattern.

In an embodiment such as FIG. 5A, where there are relatively fewer protrusion connector elements, it is beneficial to locate the protrusion connector elements near the edges or even better near the corners of a modular container so that a torsional moment between two faces of adjacent containers is greater.

In this example, both the surface connector arrangement 502 of the first type and the surface connector arrangement 504 of the second type includes central apertures 512 are configured to be used by robots end effectors for manipulating modular container 500.

FIG. 5B depicts another modular container 510 with a different surface connector arrangement 514 in the corners as compared to FIG. 5A, but otherwise including the same features. Surface connector arrangement 514 includes four of each type of connector element i.e., four of the first type of connector element 506 (protrusions) and four of the second type of connector element 508 (recesses), and is therefore rotationally symmetric about the center of the arrangement.

FIG. 5C depicts another modular container 520, which has only one surface connector arrangement 514 repeated in a grid-like fashion across all of its faces. Generally, as the number of connector element interfaces (e.g., between a protrusion and a recess) increase, so too does the shear capacity of the surface connector arrangements when mated together. Thus, modular container 520 would have very high shear capacity when connected to another modular container of the same design such that the number of connector elements interfaces is maximized for the given surface connector arrangement design.

Notably, FIGS. 5A-5C are just three examples of surface connector arrangements on modular containers, and others are possible.

Modified Surface Connector Arrangements for Corner Fittings

Surface connector arrangements, such as those described above, may also be used on corner fittings. Corner fittings are different from corner-mounted surface connectors in that corner fittings are generally independent three-dimensional structures having their own interior volume that may be joined with, attached to, or made integral with a modular container, while corner-mounted surface connectors are generally joined with, attached to, or made integral with a surface of a modular container, but do not include their own interior volume.

In the following examples, corner fittings are depicted generally in a plan view with one face showing, but note that corner fittings are generally three dimensional, and may have multiple faces, such as six faces for rectangular cuboid shapes. The faces of a corner fitting are generally joined by edges. Because corner fittings may be designed to be permanently affixed to a container, such as welded to a container, some surfaces and edges may include surface connector elements and some may not. For example, internal faces (i.e., those pointing inward toward the container and not outward), may not include surface connector elements because they would not be able to engage (or interface) with other surface connector elements on other containers. Thus, as depicted in the following examples of corner fittings, certain edges that do not show protruding surface connector elements may be located on the inward-facing faces of the corner fittings.

Figure 6:
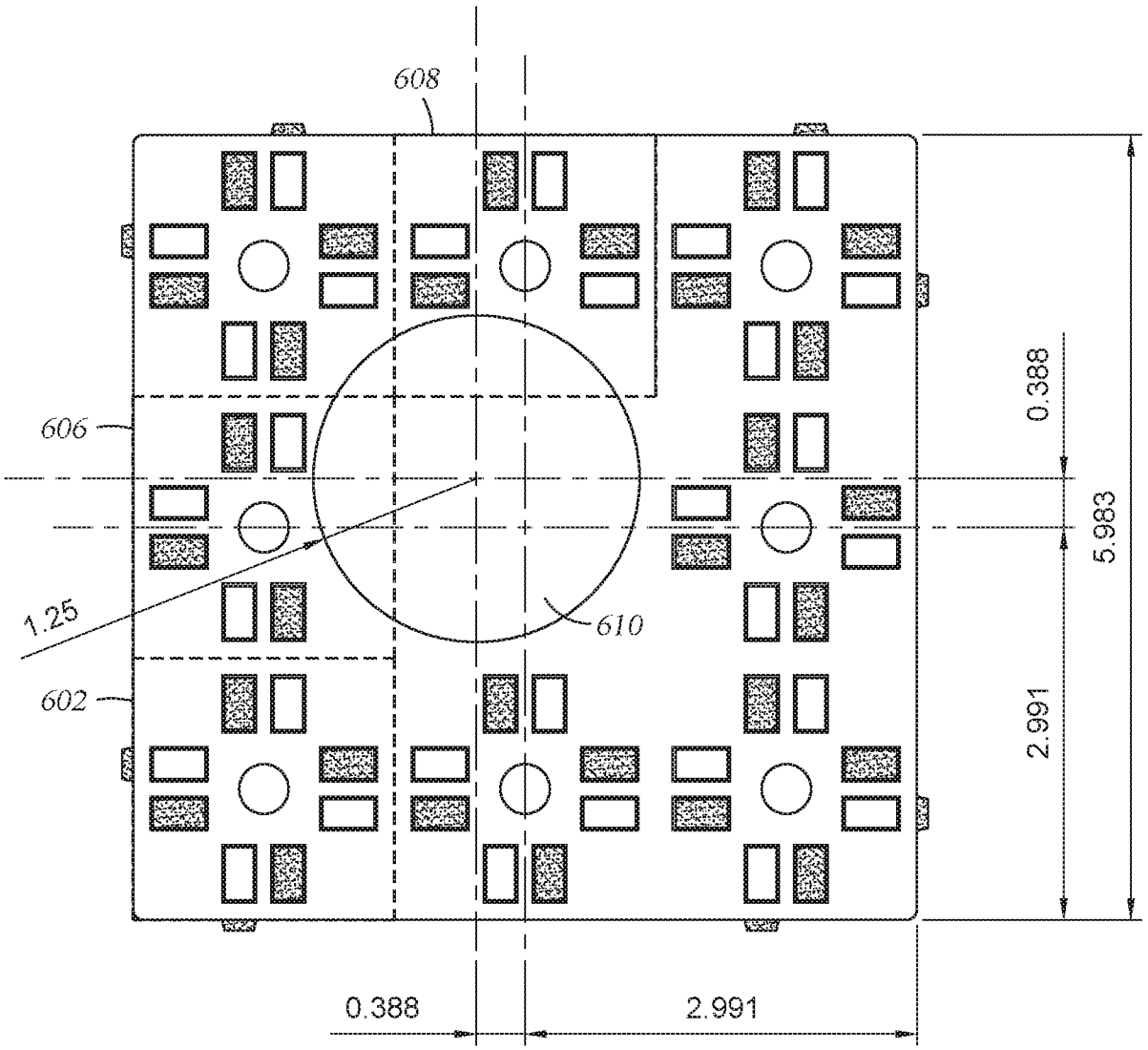
FIG. 6 depicts an example of a nominal 6-inch corner fitting with 2-inch surface connector arrangements.

FIG. 6 depicts an example of a nominal 6-inch corner fitting 600 with 2-inch surface connector arrangements.

Corner fittings, such as 600, are generally independent three-dimensional structures having their own interior volume that may be joined with, attached to, or made integral with a modular container. The interior volume of a corner fitting allows for additional forms of attachments, such as hooks, twist locks, and other connection equipment that may be standardized, for example, for use with ISO-standard containers.

The 2-inch surface connector arrangement 602 for some of the arrangements on face 604 of corner fitting 600 includes the same pattern of connector elements as discussed with respect to FIG. 5C. However, certain surface connector arrangements, such as 606 and 608 are modified to allow for the aperture 610.

In this embodiment, the center of aperture 610 is offset 3.379 inches from a first side or edge of corner fitting 600 (the left edge as depicted) and 3.379 inches from a second side or edge of corner fitting 600 (the bottom edge as depicted) to enable compatibility with existing ISO standard connection equipment.

FIGS. 7A-7F depict further examples of corner fittings that are compatible with ISO standard connection equipment, but which also include surface connector arrangements.

Figure 7A:
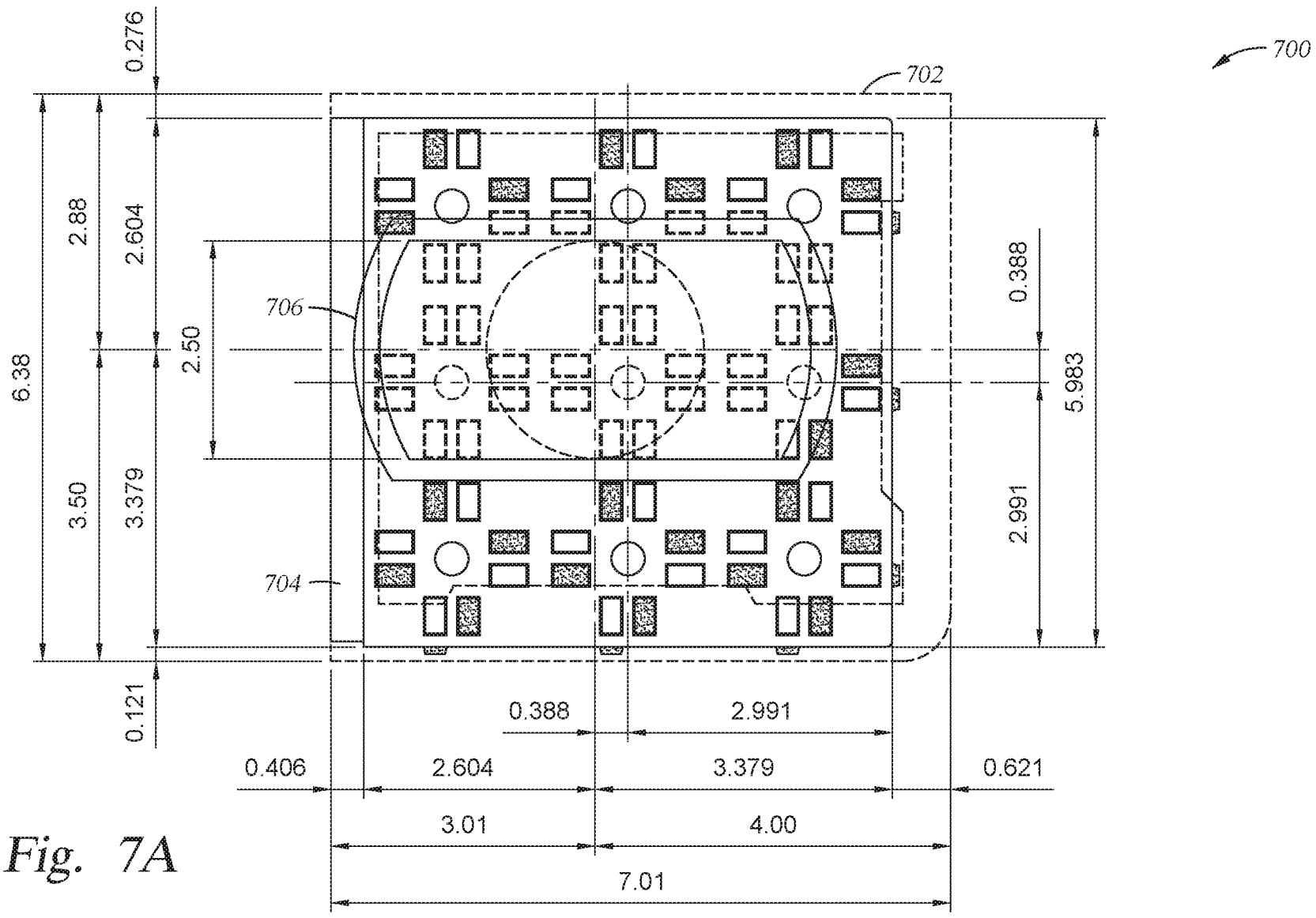
FIGS. 7A-7F depict further examples of corner fittings that are compatible with ISO standard connection equipment, but which also include surface connector arrangements.
Figure 7B:
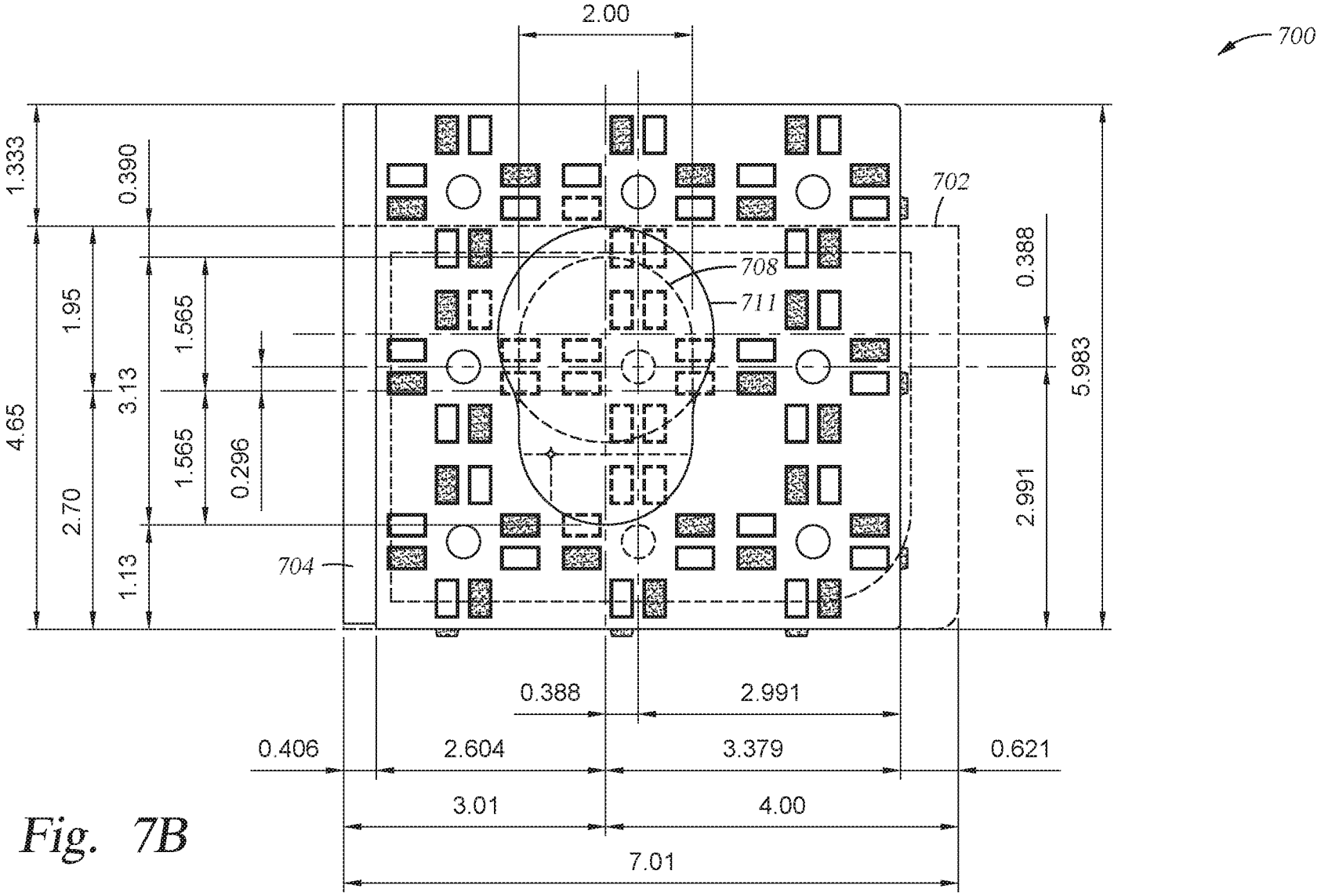
Figure 7C:
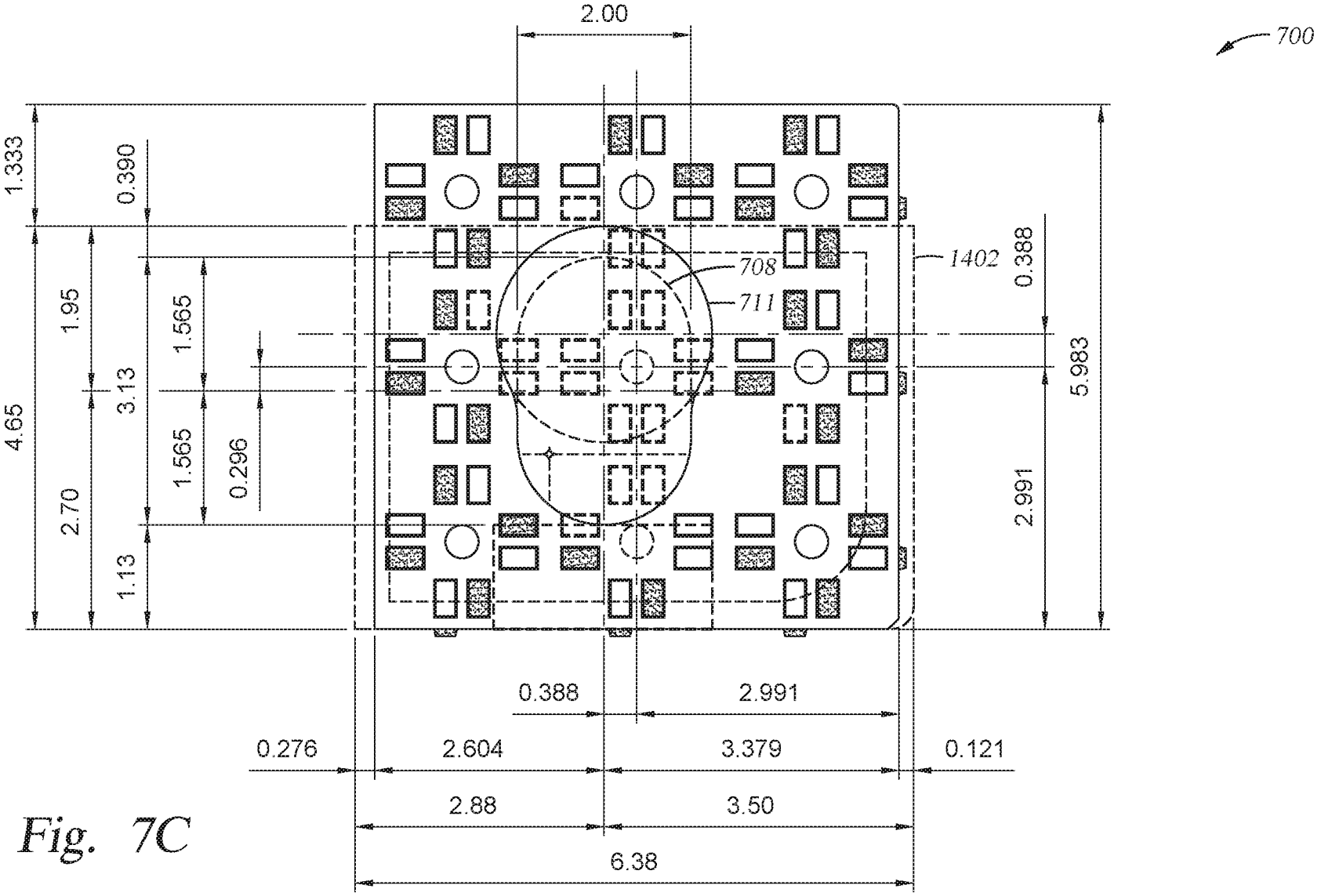

In particular, FIG. 7A depicts a bottom view of a bottom corner fitting 700 against an outline 702 of an ISO standard 6-inch bottom corner fitting. FIG. 7B depicts a side view of the bottom corner fitting 700 against an outline 702 of the ISO standard 6-inch bottom corner fitting. And FIG. 7C depicts an end view of bottom corner fitting 700 against the outline 702 of the ISO standard 6-inch corner bottom fitting. In each of FIGS. 7A-7C, certain surface connector arrangements are modified to accommodate apertures in corner fitting 700, which are compliant with ISO standard fittings. Further, omitted connector elements are represented in broken lines.

In FIGS. 7A and 7B, optional additional material 704 is depicted, which may be added to reinforce corner fitting 700 for use with the larger apertures compatible with ISO standard connection equipment. For example, as depicted in FIG. 7A, the larger central aperture option 706 would need additional material 704 to fully enclose the aperture.

In FIGS. 7B and 7C, the "keyhole"-shaped aperture 711 of corner fitting 700 has a blended shape based on the circular aperture 610 in FIG. 6 and an ISO-sized aperture, which is shown in partial outline at 708. This allows the aperture 711 to be forward and reverse compatible. In particular, FIG. 7C depicts the corner fitting 700 against an outline 1402 of an ISO standard connection equipment.

Figure 7D:
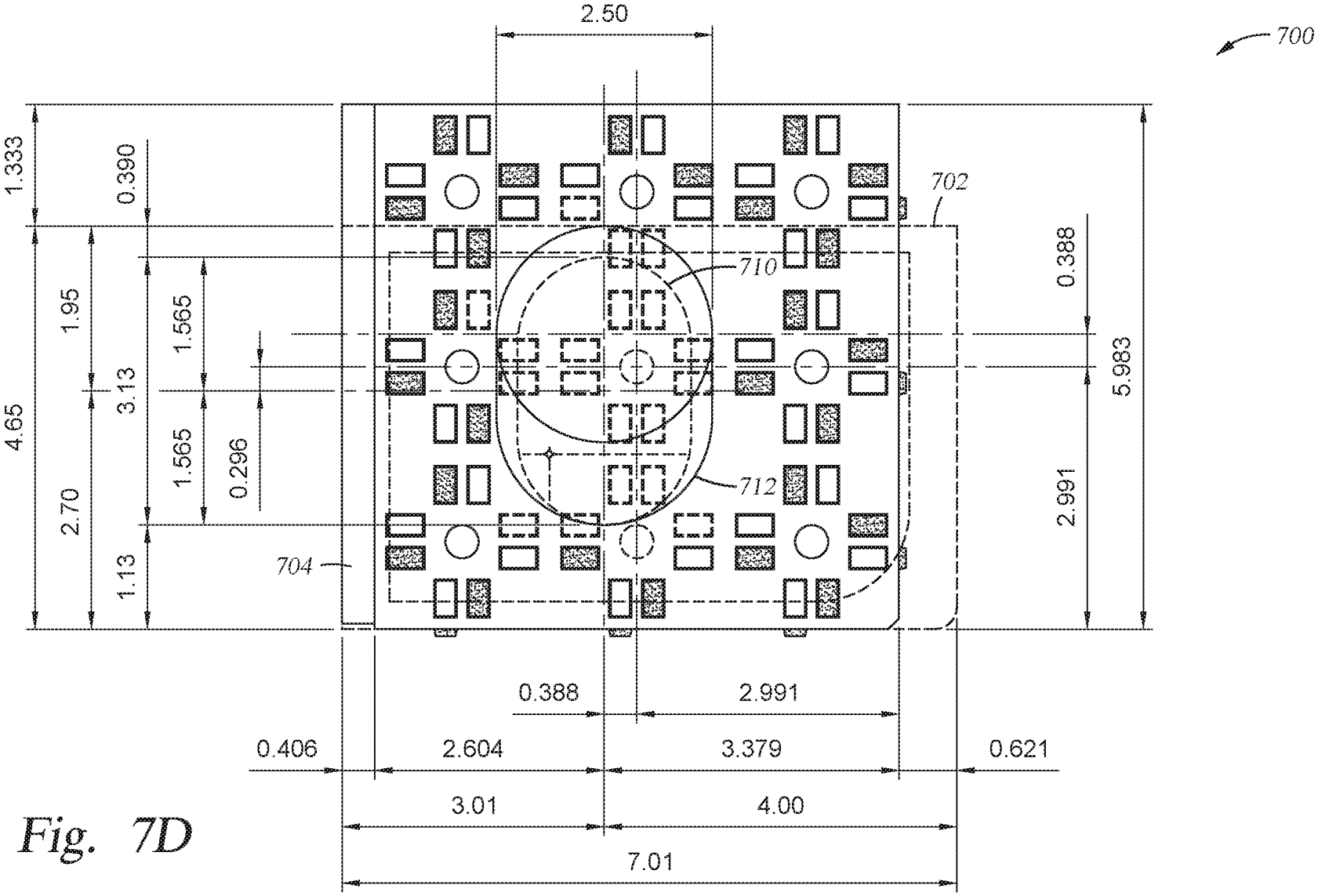
Figure 7E:
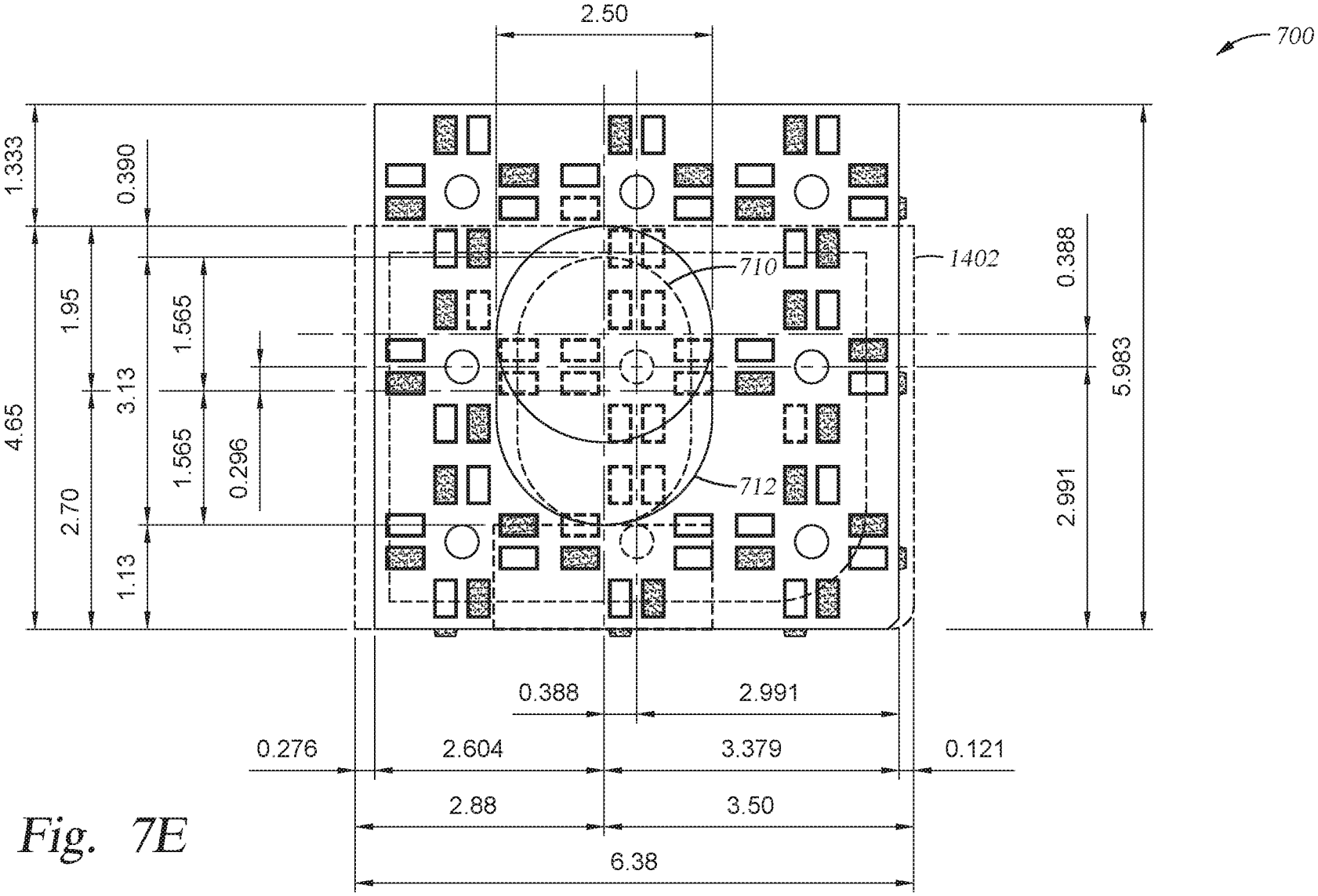

FIGS. 7D and 7E depict alternative examples where the aperture 712 is "pill" shaped and sized consistent with the diameter of the circular aperture 610 in FIG. 6. While the resulting aperture 712 is larger than the ISO-standard aperture, shown by outline 710, aperture 712 is still compatible with ISO-standard connection equipment.

Figure 7F:
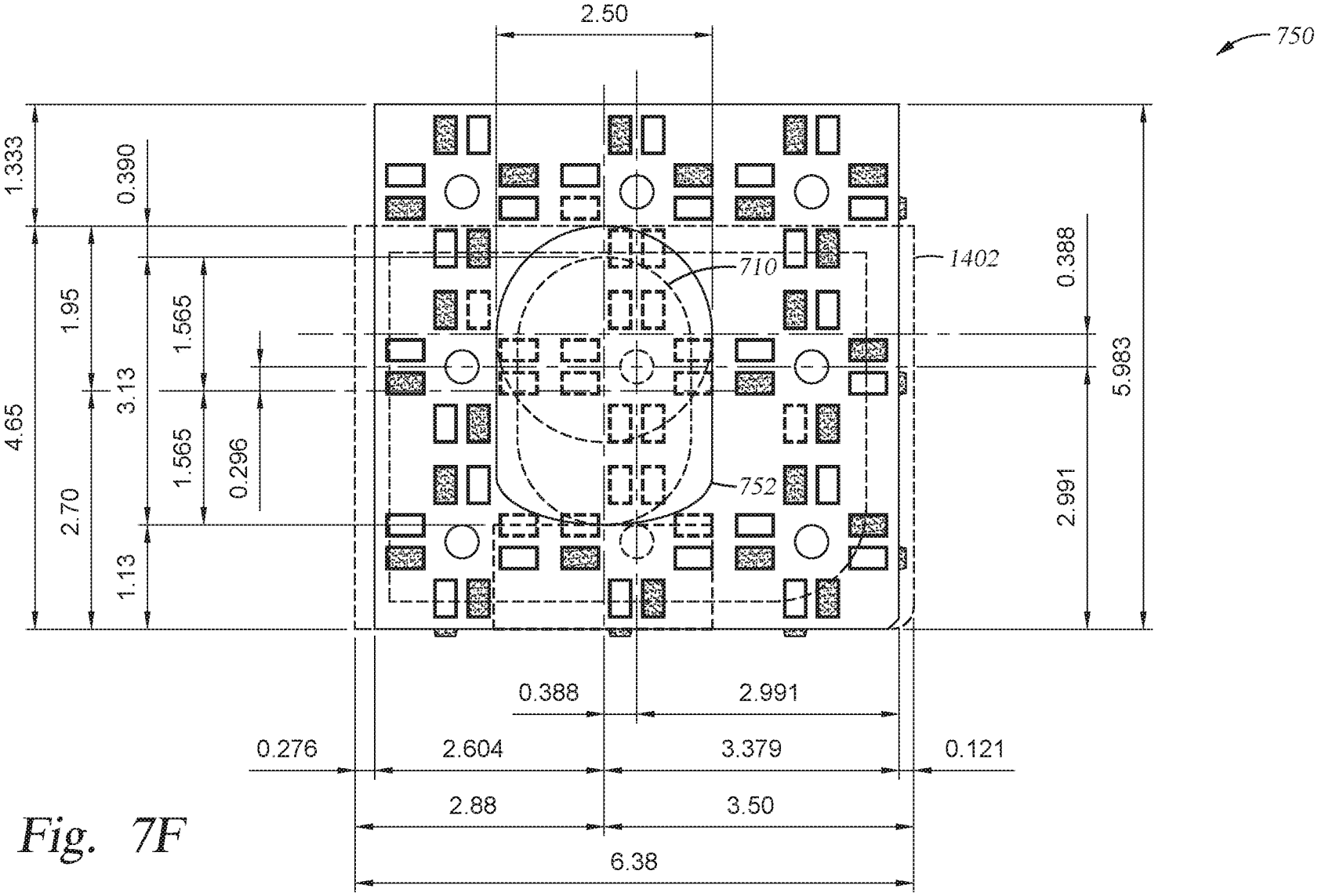

FIG. 7F depicts an end view of a top corner fitting 750, which includes an aperture 752 that is compatible with ISO standard connection equipment.

Notably, FIGS. 6-7F depict various examples of top and bottom corner fittings. In examples where only a single side of the corner fitting geometry is depicted, such as a top and left sided corner fitting, the opposite side, such as a top and right corner fitting, can be determined by mirroring the dimensions from right to left or vice versa.

Figure 8A:
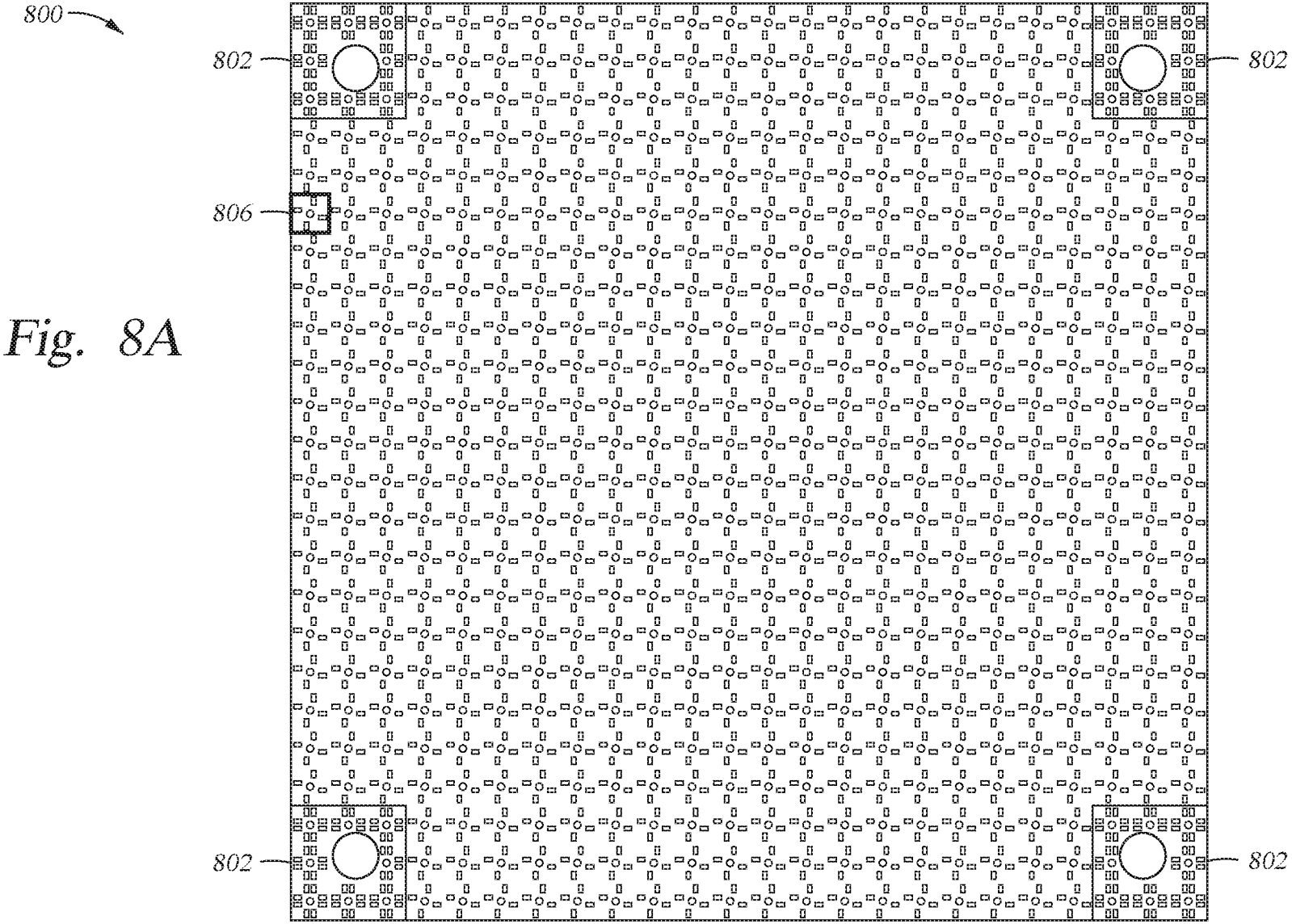
FIGS. 8A-8B depict examples of modular container arrangements, which includes corner fittings and 2-inch surface connector arrangements.

Agglomerated Modular Containers with Surface Connector Arrangements and Corner Fittings FIG. 8A depicts an example of an example of a nominally 4-foot modular container 800, which includes corner fittings 802 at each corner. The corner fittings in this example are the same as that described above with respect to FIG. 6, which include two-way surface connector arrangements, but in other examples, the corner fittings could be embodiments as described with respect to FIGS. 7A-7C.

Modular container 800 also includes a plurality of one-way surface connector arrangements 806 arranged in a grid, which are like the arrangement 504 discussed above with respect to FIG. 5A. The surface connector arrangements are considered one way in this example because they only include one type of connector element (here, a recess, but in other embodiments, they could include only protrusions). However, in other embodiments, they may have an arrangement similar to that shown in FIG. 4C, where there are more protrusions.

Figure 8B:
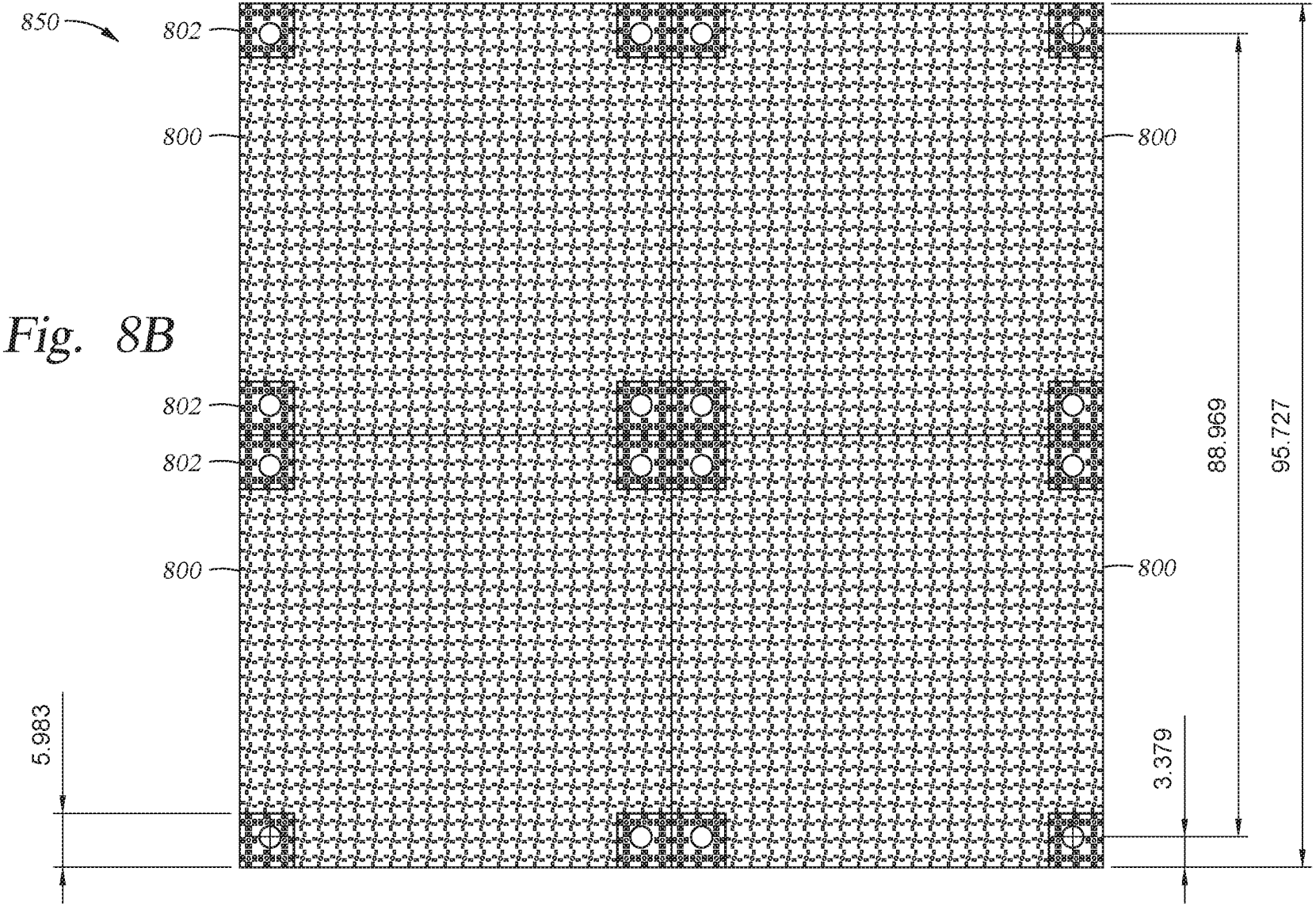

FIG. 8B depicts an agglomerated container 850 that is formed from 4-foot modular containers 800, as depicted in FIG. 8A. Notably, the dimensions of agglomerated container 850 and the locations of the corner fittings 802 are compatible with ISO standard connection equipment.

Note that while FIG. 8B depicts two layers of agglomerated modular containers 800 in which each container includes corner fittings 802, in other embodiments, only the bottom layer of modular containers 800 may include corner fittings 802. Such embodiments may improve the storage capacity of the layers above the bottom layer by omitting the corner fittings 802.

Further, while FIG. 8B depicts an agglomerated container 850 including modular containers 800 of all the same size, a variety of sizes may be used in other embodiments. By using surface connector arrangements of consistent size, e.g., 2-inch patterns, modular containers of many different sizes may be connected with each other.

Further, while FIG. 8B depicts an agglomerated container 850 of a regular shape (here a cube), irregular shapes comprising uneven numbers of agglomerated containers may be formed.

For example, a non-uniform agglomeration of smaller containers may be used while still taking advantage of ISO standard connection equipment. In one example, a bottom layer of modular containers in an agglomerated container has a square cross-sectional area (or footprint) and each modular container on the bottom layer includes ISO-compatible corner fittings, which enables connection to ISO standard connection equipment. The layers above the bottom layer, by contrast, may have different cross-sectional areas (or footprints) owing to the different configuration of connected modular containers in each layer.

Further, five agglomerated containers like agglomerated container 850 could be further joined using their surface connector arrangements and be compatible with larger ISO standard connection equipment, such as for 40-foot ISO standard mounts.

Note that while the example in FIG. 8B includes 4-foot modular containers connected to form an 8-foot agglomerated container, many other sizes may be used because of the small 2-inch surface connector arrangements. For example, 12-inch, 16-inch, 24-inch, 32-inch, 64-inch, etc. containers may be joined together to form an agglomerated container with the same ISO compatible dimensions. The wide range of container sizes that work with the 2-inch surface connector arrangements allows for customization of modular container sizes for specific markets, while allowing worldwide compatibility with international shipping container standards, like ISO.

Modular Containers with Rectangular Faces

Figure 9A:
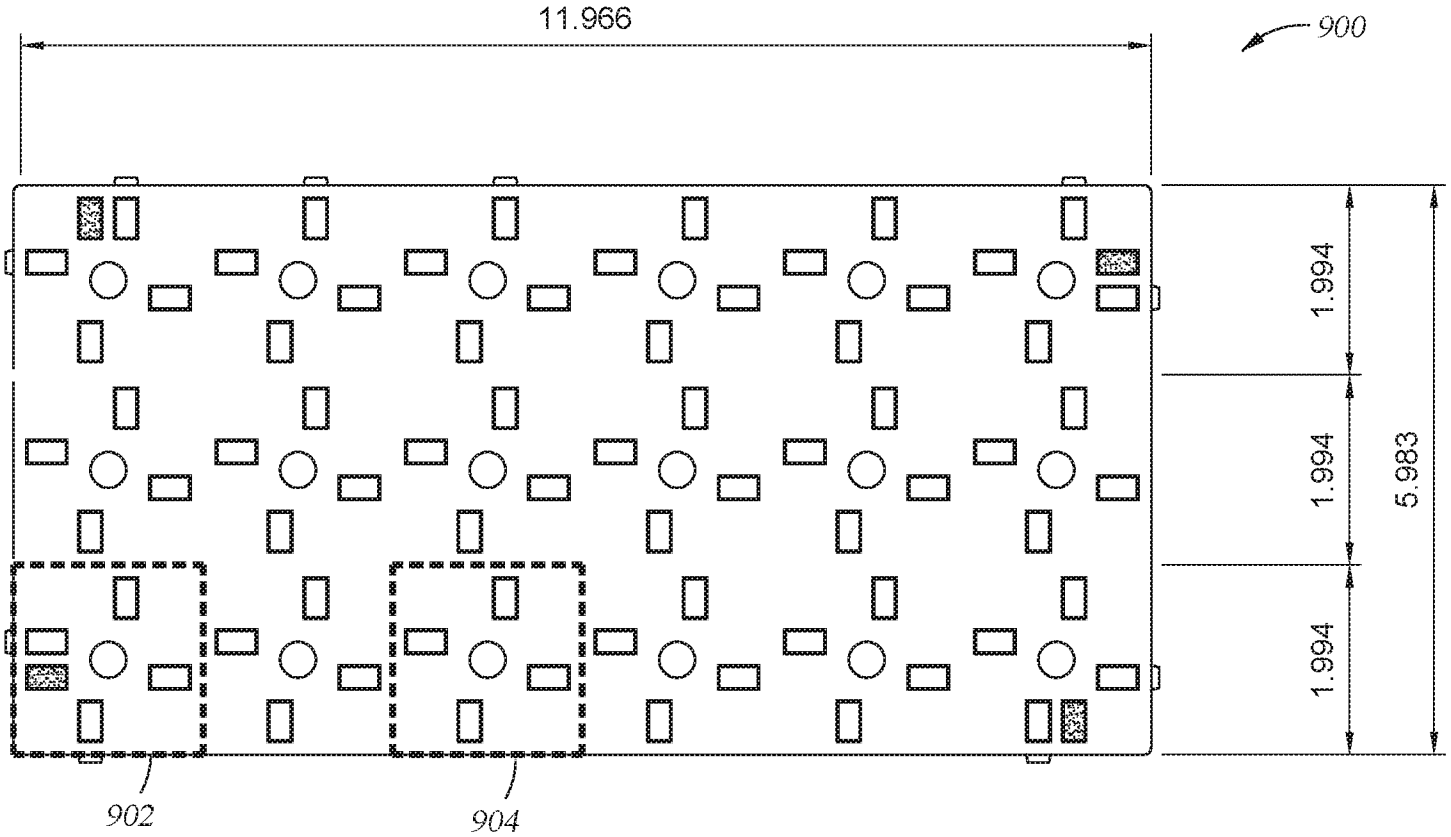
FIGS. 9A and 9B depict examples of modular containers with rectangular faces.
Figure 9B:
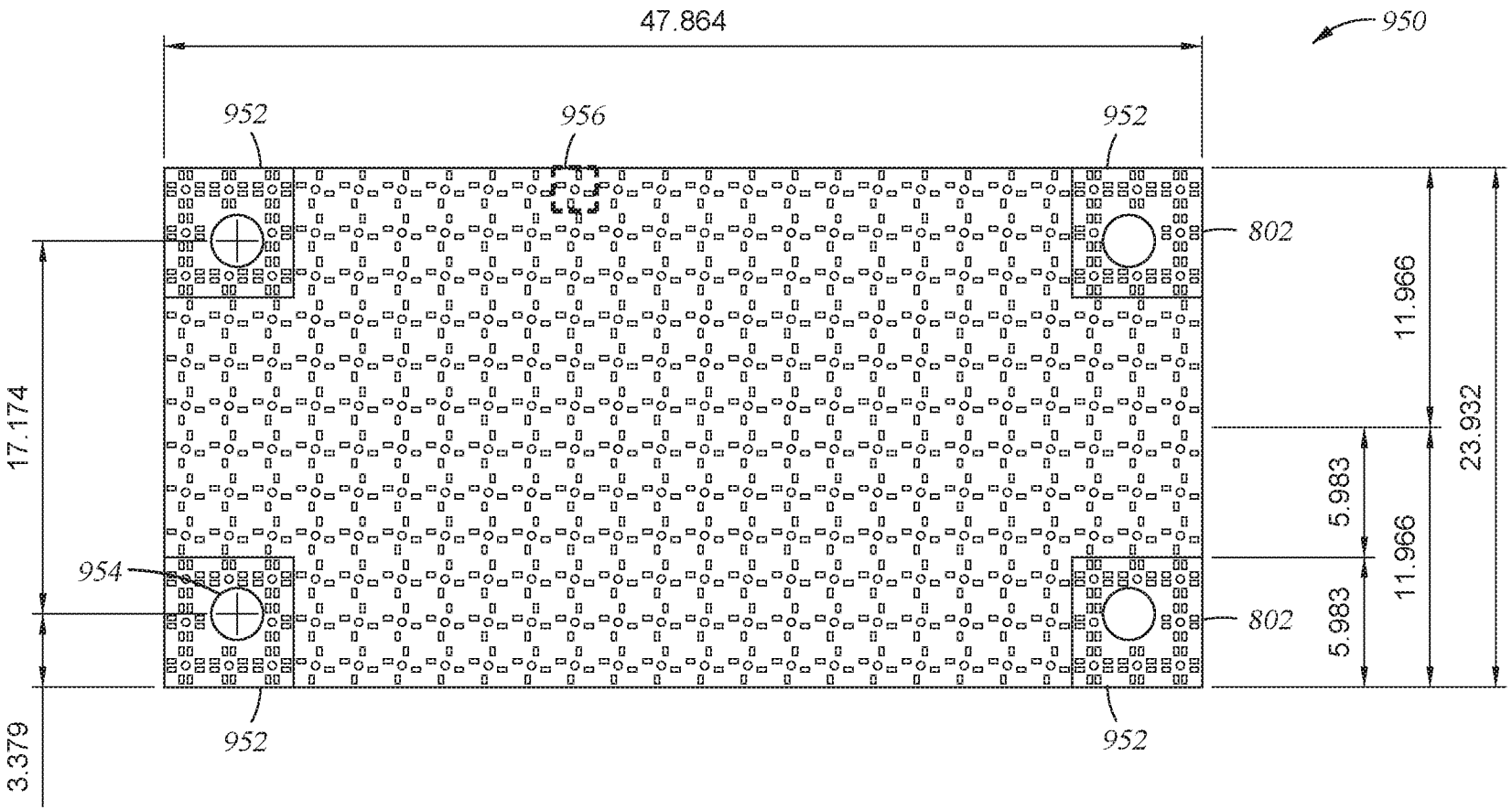

FIGS. 9A and 9B depict examples of modular containers with rectangular faces.

In particular, FIG. 9A depicts a nominal 6×12 inch rectangular face of a modular container 900 that has a rectangular cuboid shape. Generally, a cuboid is a three-dimensional shape that has six faces, which form a convex polyhedron. The faces of the cuboid can be any quadrilateral, and in some cases cuboids are made from 6 rectangles, which are placed at right angles. A cuboid that uses all square faces is referred to as a cube.

In this example, modular container 900 has two-way surface connector arrangements 902 at the corners and one-way (recess only) surface connector arrangements 904 across the remaining surface of the container faces.

The dimensions of FIG. 9A are just one example, and many other dimensions of rectangular faces are possible, such as, for example: 12×24 inch, 6×24 inch, 2×12 inch, 24×48 inch, 12×48 inch, 12×96 inch, 24×96 inch, 48×96 inch, and any other combination based on a 2-inch increment.

FIG. 9B depicts an example of a modular container 950 with a 24×48 inch face, which includes 6-inch corner fittings 952, as discussed above with respect to FIG. 6. Both the corner fittings 952 and faces of modular container 950 include surface connector arrangements (e.g., surface connector arrangements 956), as discussed herein. Further, the corner fittings 952 include apertures 954 that are configured for use with ISO standard connection equipment.

Figure 10A:
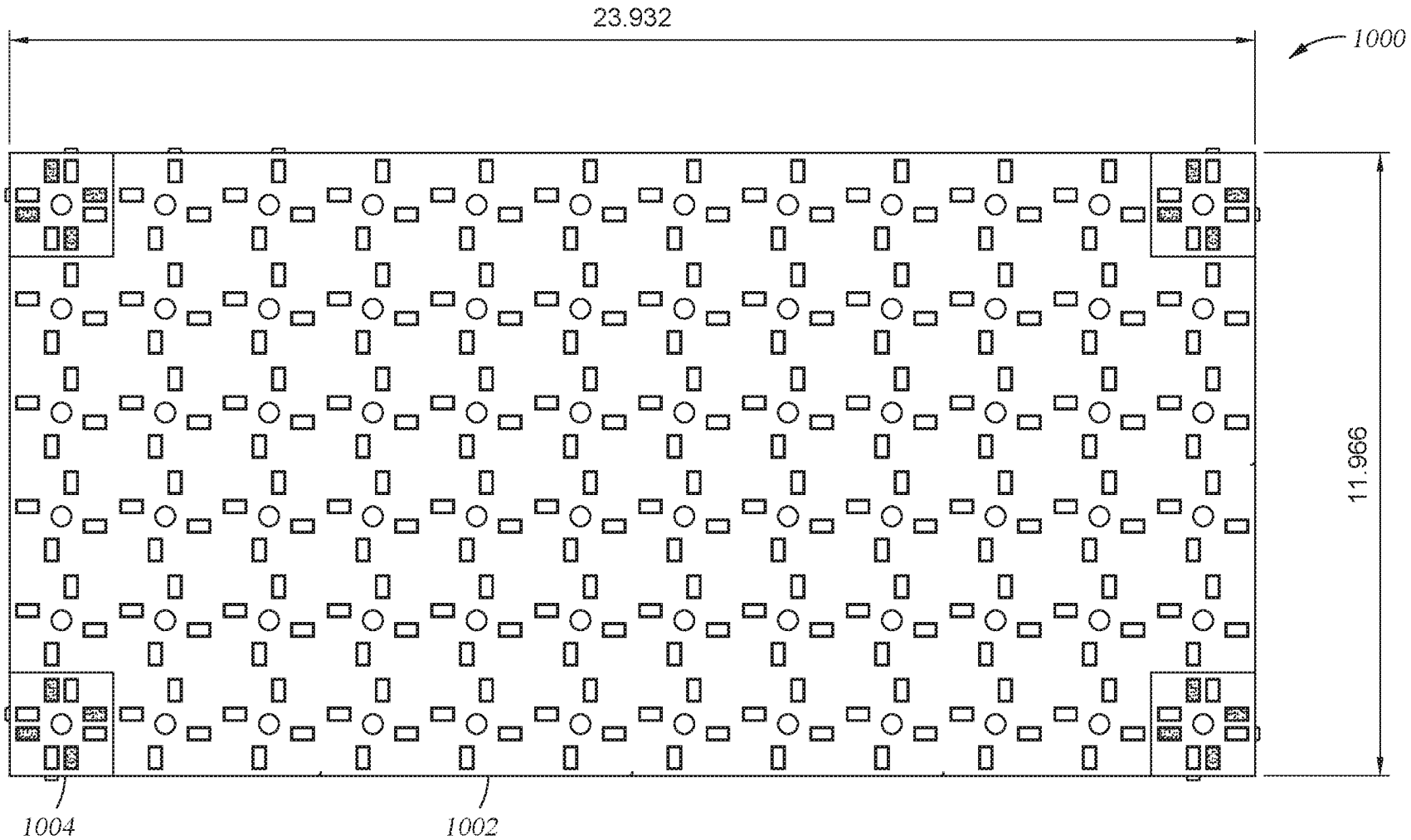
FIGS. 10A-10C depict examples of different patterns of surface connector arrangements on rectangular-faced modular containers.
Figure 10B:
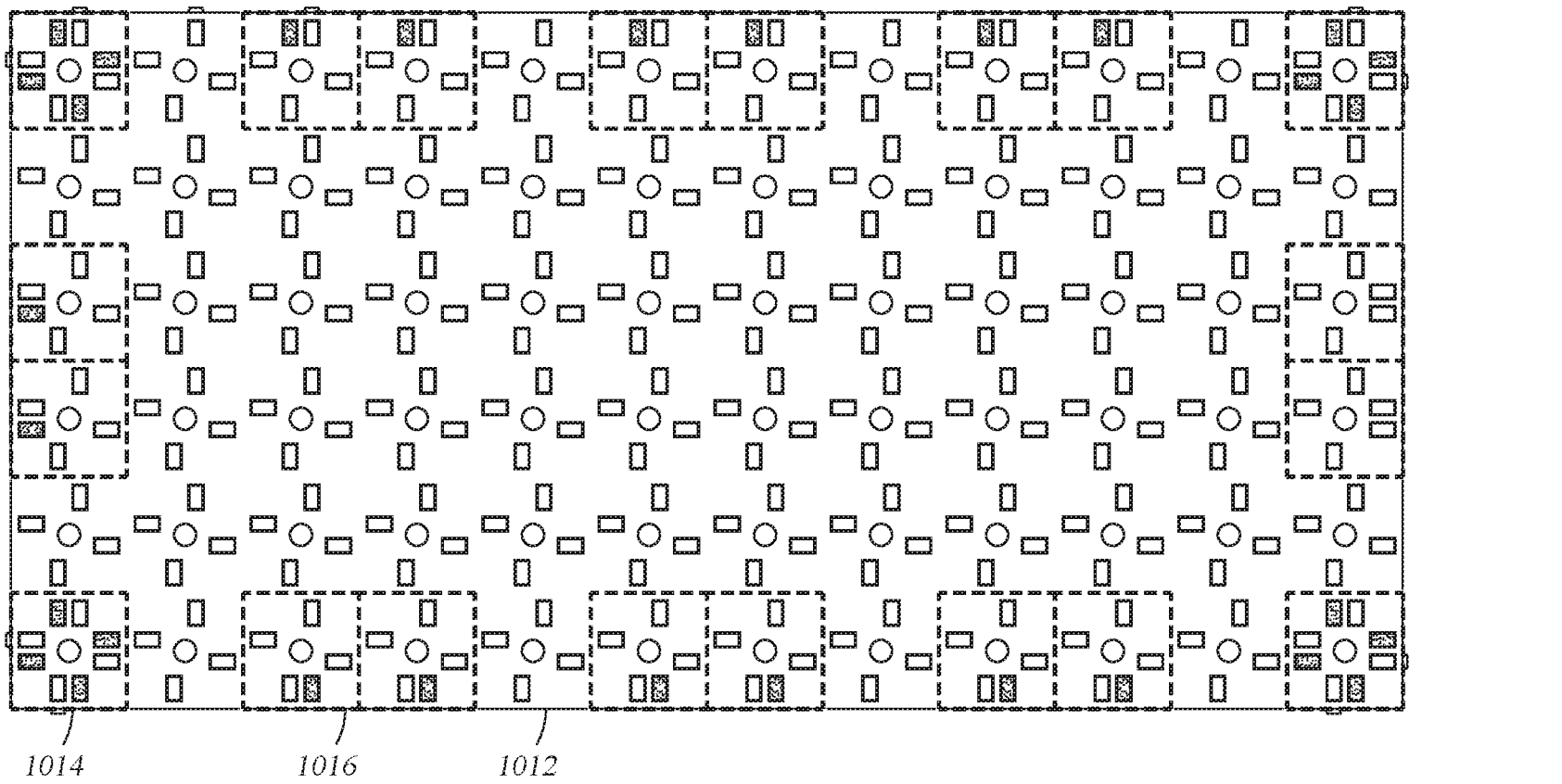
Figure 10C:
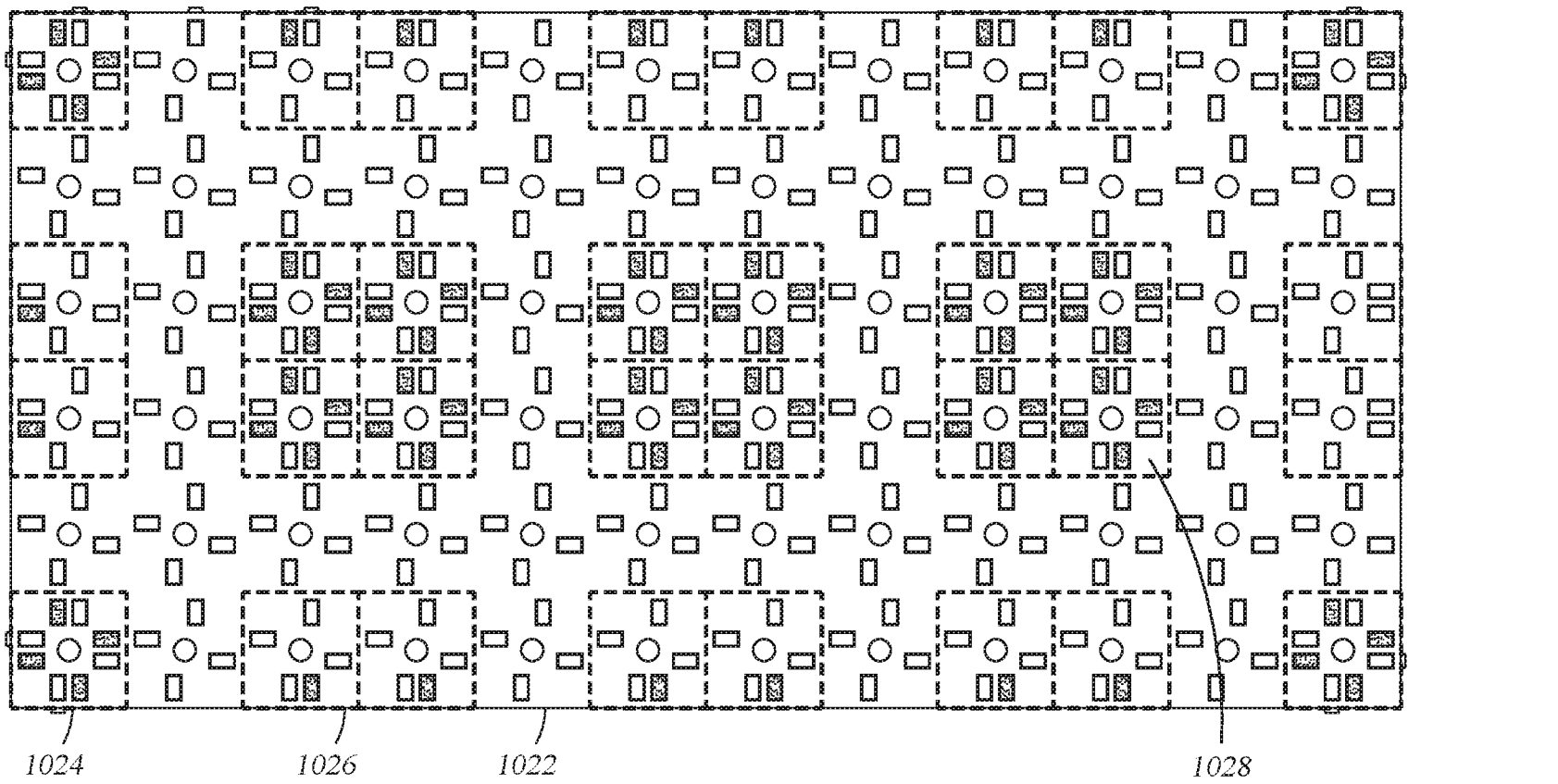

FIGS. 10A-10C depict examples of different patterns of surface connector arrangements on rectangular-faced modular containers.

For example, FIG. 10A depicts a modular container 1000 with a rectangular face 1002, which includes corner-located two-way surface connector arrangements 1004 and one way (recess only in this example) surface connector arrangements about the remainder of face 1002.

FIG. 10B depicts a modular container 1010 with a rectangular face 1012, which includes corner-located two-way surface connector arrangements and edge-located two-way surface connector arrangements 1016, with one way (recess only in this example) surface connector arrangements about the remainder of face 1012. In this example, the corner-located two-way surface connector arrangements 1014 include more connector elements than the edge-located two-way surface connector arrangements 1016, which may be due to expected load carrying characteristics of the modular container 1010.

FIG. 10C depicts a modular container 1020 with a rectangular face 1022, which includes corner-located two-way surface connector arrangements 1024, edge-located two-way surface connector arrangements 1026, and face-located two-way surface connector arrangements 1028, with one way (recess only in this example) surface connector arrangements about the remainder of face 1022. In this example, the corner-located two-way surface connector arrangements 1024 and face-located two-way surface connector arrangements 1028 include more connector elements than the edge-located two-way surface connector arrangements 1026, which may again be due to expected load carrying characteristics of the modular container 1020.

Example Method

Figure 11:
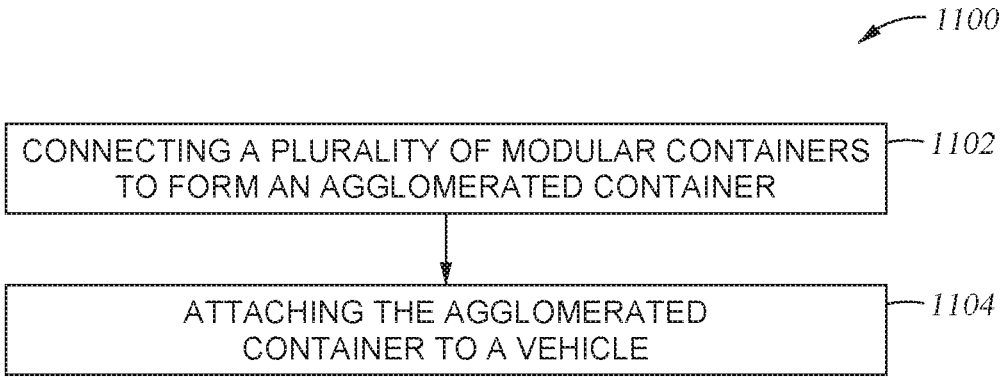
FIG. 11 depicts an example method for forming an agglomerated container.

FIG. 11 depicts an example method 1100 for forming an agglomerated container.

Method 1100 begins at step 1102 with connecting a plurality of modular containers to form an agglomerated container. For example, the modular containers may be as described above with respect to FIGS. 2-10C.

In some embodiments, each respective modular container of the plurality of modular containers comprises six sides, wherein: each side of the six sides of the modular container comprises at least four surface connector arrangements, each surface connector arrangement of the at least four surface connector arrangements comprises at least two connector elements, wherein: at least one connector element of the at least two connector elements is of a first type, and at least one connector element of the at least two connector elements is of a second type; and an access door in at least one side of the six sides.

In some embodiments, each surface connector arrangement comprises a nominal 2-inch pattern of connector elements, which may have an actual dimension of 1.994 inches.

In some embodiments, each of the plurality of modular containers is the same size, such as depicted in FIG. 8B. In some embodiments, each of the plurality of modular containers further comprises eight corner fittings, such as depicted in FIGS. 8A and 8B. In some embodiments, each respective corner fitting of the eight corner fittings for a respective modular container of the plurality of modular containers comprises a corner fitting hole centered approximately 3.379 inches from a first edge of the respective corner fitting and approximately 3.379 inches from a second edge of the respective corner fitting.

In some embodiments, the agglomerated container is approximately 95.727 inches wide, and the agglomerated container is approximately 95.727 inches long.

In some embodiments, the agglomerated container is approximately 95.727 inches wide, and the agglomerated container is approximately 119.659 inches long.

In some embodiments, the plurality of modular containers are arranged in a plurality of layers, such as depicted in FIG. 8B. In some embodiments, a bottom layer of the plurality of layers comprises a first subset of the plurality of modular containers, wherein each modular container of the first subset of the plurality of modular containers comprises: eight corner fittings, such as depicted in FIG. 8B. In some embodiments, each respective corner fitting of the eight corner fittings comprises a corner fitting hole centered approximately 3.379 inches from a first adjacent edge of the respective corner fitting and approximately 3.379 inches from a second edge of the respective corner fitting.

In some embodiments, a second layer of the plurality of layers comprises a second subset of the plurality of modular containers, and each modular container of the second subset of the plurality of modular containers is a different size than each modular container of the first subset of the plurality of modular containers. In some embodiments, each modular container of the second subset of the plurality of modular containers does not comprise a corner fitting.

Method 1100 then proceeds to step 1104 with attaching the agglomerated container to a vehicle. In some embodiments, the agglomerated container may be connected to the vehicle via one or more ISO container retainers.

In some embodiments, multiple agglomerated containers may be connected to ISO standard connection equipment on vehicle (e.g., a truck, trailer, or rail car).

The preceding description is provided to enable any person skilled in the art to practice the various embodiments described herein. The examples discussed herein are not limiting of the scope, applicability, or embodiments set forth in the claims. Various modifications to these embodiments will be readily apparent to those skilled in the art, and the generic principles defined herein may be applied to other embodiments. For example, changes may be made in the function and arrangement of elements discussed without departing from the scope of the disclosure. Various examples may omit, substitute, or add various procedures or components as appropriate. For instance, the methods described may be performed in an order different from that described, and various steps may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

As used herein, the word "exemplary" means "serving as an example, instance, or illustration." Any aspect described herein as "exemplary" is not necessarily to be construed as preferred or advantageous over other aspects.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

As used herein, "approximately" with respect to a dimension means plus or minus standard manufacturing tolerances.

The methods disclosed herein comprise one or more steps or actions for achieving the methods. The method steps and/or actions may be interchanged with one another without departing from the scope of the claims. In other words, unless a specific order of steps or actions is specified, the order and/or use of specific steps and/or actions may be modified without departing from the scope of the claims. Further, the various operations of methods described above may be performed by any suitable means capable of performing the corresponding functions.

What is claimed is:

1. A modular container, comprising:
six sides, wherein:
each side of the six sides of the modular container comprises a face and at least four surface connector arrangements of connector elements as part of the face,
each surface connector arrangement of connector elements of the at least four surface connector arrangements of connector elements comprises at least two connector elements, wherein:
at least one connector element of the at least two connector elements is of a first type comprising a protrusion, and
at least one connector element of the at least two connector elements is of a second type comprising a recess; and
an access door in at least one side of the six sides.

2. The modular container of claim 1, wherein each surface connector arrangement of connector elements comprises a 2-inch pattern of connector elements.

3. The modular container of claim 2, wherein each side of the six sides of the modular container further comprises four corner fittings.

4. The modular container of claim 3, wherein each respective corner fitting of the four corner fittings comprises:
a first face on a first side of the six sides of the modular container,
a second face on a second side of the six sides of the modular container,
a third face on a third side of the six sides of the modular container, and
an aperture centered approximately 3.379 inches from a first edge of the respective corner fitting and approximately 3.379 inches from a second edge of the respective corner fitting.

5. The modular container of claim 1, wherein at least two sides of the six sides of the modular container are rectangular.

6. The modular container of claim 1, wherein: at least one side of the six sides comprises a surface connector arrangement of connector elements of a first type and a surface connector arrangement of connector elements of a second type.

7. The modular container of claim 1, wherein each face of each side of the six sides comprises one of a corner-located, an edge-located, or a face-located surface connector arrangement of connector elements.

8. An agglomerated container, comprising:
a plurality of modular containers, wherein:
each respective modular container of the plurality of modular containers comprises six sides,
each side of the six sides of a respective modular container comprises a face and at least four surface connector arrangements of connector elements as part of the face, wherein:
each surface connector arrangement of connector elements of the at least four surface connector arrangements of connector elements comprises at least two connector elements,
at least one connector element of the at least two connector elements is of a first type comprising a protrusion, and
at least one connector element of the at least two connector elements is of a second type comprising a recess; and
each respective modular container of the plurality of modular containers is connected to another modular container of the plurality of modular containers via engagement between one or more surface connector arrangements of connector elements on a first side of the respective modular container and one or more surface connector arrangements of connector elements on a first side of the another modular container.

9. The agglomerated container of claim 8, wherein:
each of the plurality of modular containers is a same size,
each of the plurality of modular containers further comprises eight corner fittings, wherein:
each respective corner fitting of the eight corner fittings for a respective modular container of the plurality of modular containers comprises a corner fitting aperture centered approximately 3.379 inches from a first edge of the respective corner fitting and approximately 3.379 inches from a second edge of the respective corner fitting.

10. The agglomerated container of claim 8, wherein:
the agglomerated container is approximately 95.727 inches wide, and
the agglomerated container is approximately 95.727 inches long.

11. The agglomerated container of claim 8, wherein:
the agglomerated container is approximately 95.727 inches wide, and
the agglomerated container is approximately 119.659 inches long.

12. The agglomerated container of claim 8, wherein:

the plurality of modular containers is arranged in a plurality of layers, a first layer of the plurality of layers comprises a first subset of the plurality of modular containers, wherein each modular container of the first subset of the plurality of modular containers comprises:

eight corner fittings, wherein each respective corner fitting of the eight corner fittings comprises a corner fitting aperture centered approximately 3.379 inches from a first edge of the respective corner fitting and approximately 3.379 inches from a second edge of the respective corner fitting.

13. The agglomerated container of claim 12, further comprising:

a second layer of the plurality of layers comprising a second subset of the plurality of modular containers, wherein each modular container of the second subset of the plurality of modular containers does not comprise a corner fitting.

14. The agglomerated container of claim 8, wherein:

the plurality of modular containers is arranged in a plurality of layers, a first layer of the plurality of layers has a first cross-sectional area, and a second layer of the plurality of layers has a second cross-sectional area that is different than the first cross-sectional area.

15. The agglomerated container of claim 8, wherein:

the plurality of modular containers comprises a first subset of modular containers of a first size, and the plurality of modular containers comprises a second subset of modular containers of a second size.

16. A method of forming an agglomerated container, comprising:

connecting a plurality of modular containers to form an agglomerated container, wherein:

each respective modular container of the plurality of modular containers comprises six sides, wherein:

each side of the six sides of the modular container comprises a face and at least four surface connector arrangements of connector elements as part of the face, each surface connector arrangement of connector elements of the at least four surface connector arrangements of connector elements comprises at least two connector elements, wherein:

at least one connector element of the at least two connector elements is of a first type comprising a protrusion, and at least one connector element of the at least two connector elements is of a second type comprising a recess; and each respective modular container of the plurality of modular containers is connected to another modular container of the plurality of modular containers via engagement between one or more surface connector arrangements of connector elements on a first side of the respective modular container and one or more surface connector arrangements of connector elements of a first side of the another modular container.

17. The method of claim 16, wherein each surface connector arrangement of connector elements of the at least four surface connector arrangements of connector elements comprises a 2-inch pattern of connector elements.

18. The method of claim 16, wherein:

each of the plurality of modular containers is a same size, and each of the plurality of modular containers further comprises eight corner fittings, each respective corner fitting of the eight corner fittings for a respective modular container of the plurality of modular containers comprises a corner fitting aperture centered approximately 3.379 inches from a first edge of the respective corner fitting and approximately 3.379 inches from a second edge of the respective corner fitting.

19. The method of claim 16, wherein:

the agglomerated container is approximately 95.727 inches wide, and the agglomerated container is approximately 95.727 inches long.

20. The method of claim 16, further comprising: attaching the agglomerated container to ISO standard connection equipment on a vehicle.

* * * * *